US007597417B2

(12) United States Patent
Nagashima

(10) Patent No.: US 7,597,417 B2
(45) Date of Patent: Oct. 6, 2009

(54) DISCHARGE DETERMINATION DEVICE AND METHOD

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 310 days.

(21) Appl. No.: 11/072,239

(22) Filed: Mar. 7, 2005

(65) Prior Publication Data

US 2005/0195248 A1 Sep. 8, 2005

(30) Foreign Application Priority Data

Mar. 8, 2004 (JP) ..... 2004-064028

(51) Int. Cl.
*B41J 29/393* (2006.01)
*B41J 2/19* (2006.01)
*B41J 2/45* (2006.01)

(52) U.S. Cl. ..... 347/19; 347/70; 347/92

(58) Field of Classification Search ..... 347/19, 347/92

See application file for complete search history.

(56) References Cited

U.S. PATENT DOCUMENTS

| | | | | |
|---|---|---|---|---|
| 4,034,380 | A * | 7/1977 | Isayama | 347/19 |
| 4,498,088 | A * | 2/1985 | Kanayama | 347/92 |
| 4,604,633 | A * | 8/1986 | Kimura et al. | 347/7 |
| 4,695,852 | A * | 9/1987 | Scardovi | 347/92 |
| 4,977,413 | A | 12/1990 | Yamanaka et al. | |
| 5,500,657 | A | 3/1996 | Yauchi et al. | |
| 5,729,256 | A | 3/1998 | Yamanaka et al. | |
| 5,757,392 | A | 5/1998 | Zhang | |
| 6,186,610 | B1 * | 2/2001 | Kocher et al. | 347/19 |
| 6,513,902 | B1 | 2/2003 | Amano et al. | |
| 6,549,631 | B1 | 4/2003 | Jackson | |
| 6,682,162 | B2 * | 1/2004 | Simons et al. | 347/19 |
| 7,108,348 | B2 * | 9/2006 | Shinkawa et al. | 347/19 |
| 2004/0169696 | A1 | 9/2004 | Dietl | |

(Continued)

FOREIGN PATENT DOCUMENTS

EP 1 092 543 A2 4/2001

(Continued)

*Primary Examiner*—Matthew Luu
*Assistant Examiner*—Shelby Fidler
(74) *Attorney, Agent, or Firm*—Birch, Stewart, Kolasch & Birch, LLP

(57) ABSTRACT

The discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprises: a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator.

25 Claims, 17 Drawing Sheets

U.S. PATENT DOCUMENTS

| | | | | |
|---|---|---|---|---|
| 2006/0077219 | A1* | 4/2006 | Kusakari | 347/19 |
| 2006/0221144 | A1* | 10/2006 | Nagashima | 347/19 |
| 2007/0103500 | A1* | 5/2007 | Ootsuka | 347/19 |

FOREIGN PATENT DOCUMENTS

| | | | |
|---|---|---|---|
| JP | 63-257646 | A | 10/1988 |
| JP | 5-131644 | A | 5/1993 |
| JP | 6-91204 | A | 4/1994 |
| JP | 11-115201 | A | 4/1999 |
| JP | 11-129472 | A | 5/1999 |
| JP | 11-286124 | A | 10/1999 |
| JP | 11-309874 | A | 11/1999 |
| JP | 2000-43253 | A | 2/2000 |
| JP | 2001059786 | A | 3/2001 |
| JP | 2001-105606 | A | 4/2001 |
| JP | 2004-58531 | A | 2/2004 |
| JP | 2004237566 | A | 8/2004 |
| JP | 2004262245 | A | 9/2004 |

* cited by examiner

DISCHARGE DETERMINATION DEVICE AND METHOD

BACKGROUND OF THE INVENTION

1. Field of the Invention

The present invention relates to a discharge determination device and method, and more specifically to a discharge determination device and method suitable for determining discharge errors in a discharge head having a plurality of droplet discharge ports (nozzles).

2. Description of the Related Art

An inkjet type recording apparatus forms images on a recording medium by discharging ink from nozzles while moving a print head having a plurality of nozzles and a recording medium relatively with respect to each other. In an apparatus of this kind, discharge errors may arise, namely, ink may cease to be discharged from the nozzles, or the amount of ink discharged (the dot size deposited on the recording medium) or the position at which the ink is deposited may become defective, as a result of increase in the viscosity of the ink, infiltration of air bubbles into the ink, or the like. Therefore, technology for determining whether or not ink droplets have been discharged from nozzles and for restoring discharge failures have been proposed (see Japanese Patent Application Publication Nos. 5-131644 and 11-286124).

The inkjet heads disclosed in Japanese Patent Application Publication Nos. 5-131644 and 11-286124 have piezoelectric elements for applying pressure required in order to discharge ink, and ink discharge failures are determined from the response of the piezoelectric elements after an ink discharge operation (after pressurization).

Furthermore, Japanese Patent Application Publication No. 11-129472 proposes an inkjet recording apparatus provided with an ink end detector which detects the end of ink accurately, in such a manner that the ink inside a cartridge can be used without creating waste. More specifically, the inkjet head disclosed in Japanese Patent Application Publication No. 11-129472 comprises a plurality of nozzles, discharge chambers connected to the respective nozzles, and a reservoir (common liquid chamber) connected to the discharge chambers. Ink droplets are discharged from the nozzles by generating a pressure inside the discharge chambers. A diaphragm which can deform in accordance with the pressure inside the discharge chambers is formed in one part of the reservoir. A semiconductor diffusion resistance type pressure sensor is provided in the diaphragm, and change in the resistance value measured by the sensor is determined by a determination circuit. If a change in the resistance value equal to or exceeding a prescribed amount is detected, then an ink end reporting device informs the user that the ink has ended.

The principal reason for ink discharge ceasing to function normally is the presence of air bubbles inside or in the vicinity of the pressure chambers (which correspond to the "discharge chambers" in Japanese Patent Application Publication No. 11-129472). Since the air bubbles absorb the pressure by changing volume, then the pressure generated by the actuators for ink discharge cannot be used efficiently in order to discharge the ink. Consequently, it is possible to ascertain the discharge status by determining whether or not air bubbles are present inside or in the vicinity of the pressure chambers, and whether or not the pressure generated by the actuators is being transmitted to the ink as intended.

On this point, in Japanese Patent Application Publication Nos. 5-131644 and 11-286124, the piezoelectric effect of the piezoelectric elements (piezo elements) used to create discharge pressure is taken as a basis for determining whether or not discharge has occurred. It is judged whether or not discharged has been carried out normally by observing the determination signal after discharge driving (after pressurization). However, these publications do not disclose the acquisition of a determination signal during pressurization. Supposing that it were attempted to determine the status during pressurization by means of the composition described in Japanese Patent Application Publication No. 5-131644 or 11-286124, the circuit composition would become extremely complicated.

On the other hand, Japanese Patent Application Publication No. 11-129472 determines the change in the negative pressure when the ink separates, accurately, by providing a sensor in the reservoir near the discharge chambers. However, it does not determine ink discharge errors.

SUMMARY OF THE INVENTION

The present invention has been contrived in view of the foregoing circumstances, an object thereof being to provide a discharge determination device or determination method suitable for accurately judging whether or not a discharge failure has occurred, and for efficiently determining a plurality of nozzles in a long head, or the like, by determining the level of the ink pressure in the pressure chambers or in the vicinity of same, with respect to the pressure generated by the actuators.

In order to attain the aforementioned object, the present invention is directed to a discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising: a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator.

According to the present invention, a composition is adopted which determines pressure change in the liquid by means of displacement of a film member disposed at the face of the pressure chamber, and hence evaluates how the pressure generated by the actuator is transmitted to the liquid. Therefore, from this determination information, it is possible to judge not only whether or not liquid is present, but also whether or not an air bubble which would cause discharge failure due to pressure loss is present. Consequently, it can be judged whether or not the pressure chamber is in a state producing a discharge failure. Furthermore, in order to prevent the displacement of the film member according to the present invention from affecting the discharge of liquid, the reduction in discharge performance due to addition of the pressure determination device is reduced to a minimum.

Possible modes are ones in which the displacement of the film member is displacement caused by deformation of the film member, displacement caused by movement of the film member, or displacement caused by a combination of these.

A desirable mode of the present invention is one in which the film member has rigidity, or is provided with a mechanism, which causes the film member to returns to its initial state (shape or position) during replenishment after discharge, in such a manner that a liquid replenishment force is generated.

Preferably, the film member is displaceable within a range of displacement which allows the liquid to be discharged by driving of the actuator.

Preferably, the film member is constituted in such a manner that the film member reverts to an initial state of the film member upon replenishment of the liquid into the pressure chamber after the discharge of the droplet.

Preferably, an amount of displacement of the film member is equal to or less than ½ in terms of a loss of pressure generated by the actuator in order to discharge the droplet.

If these conditions are satisfied, then the displacement of the film member has virtually no effect on the liquid discharge characteristics.

Preferably, a displacement volume of the film member is equal to or less than ½ of a removed volume of the pressure chamber caused by the actuator. Here, "removed volume" means the volume of the deformation of the pressure chamber when the actuator seeks to push out the liquid. If these conditions are satisfied, then the displacement of the film member has virtually no effect on the liquid discharge characteristics.

Preferably, a sum of a volume of the liquid returning to a supply flow channel side from the pressure chamber upon discharge of the droplet by driving of the actuator, plus a displacement volume of the film member, is equal to or less than ½ of a removed volume of the pressure chamber caused by the actuator.

Moreover, a composition is preferably adopted whereby the displacement volume of the film member is less than the volume of the liquid returning to the supply side flow channel, and desirably, the displacement volume of the film member is less than ¼ of the volume of the liquid returning to the supply side flow channel.

Preferably, a sum of a volume of liquid flowing to a nozzle side from the pressure chamber upon discharge of the droplet by driving of the actuator, plus a displacement volume of the film member, is equal to or less than ½ of a removed volume of the pressure chamber caused by the actuator.

Moreover, a composition is preferably adopted whereby the displacement volume of the film member is less than the volume of the liquid flowing to the nozzle side, and desirably, the displacement volume of the film member is less than ¼ of the volume of the liquid flowing to the nozzle side.

Preferably, the pressure determination device comprises a displacement restriction device which restricts an amount of displacement of the film member. The displacement restriction device may be composed so as to restrict displacement in both directions in which the film member is displaced (namely, the liquid side and the opposite side to same), or to restrict displacement in either one of these directions.

By adding a displacement restriction device, it is possible to achieve a non-linear response of the film member whereby it is displaced rapidly in the initial phase of pressure change but is not displaced further once the required displacement has been obtained. Therefore, high-precision pressure determination can be achieved without significantly affecting liquid discharge.

In order to attain the aforementioned object, the present invention is also directed to a discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising: a pressure determination device which is disposed inside the supply flow channel connected to the pressure chamber and includes a film member forming a portion of a face constituting the supply flow channel, the film member being displaceable in accordance with pressure change in the liquid inside the flow channel, the pressure determination device outputting a determination signal in accordance with displacement of the film member; and a discharge status judging device which judges the discharge status of the nozzle according to the determination signal obtained from the pressure determination device in accordance with driving of the actuator.

Preferably, the film member is displaceable within a range of displacement which allows the liquid to be discharged by driving of the actuator.

Preferably, the film member is constituted in such a manner that the film member reverts to an initial state of the film member upon replenishment of the liquid into the pressure chamber after the discharge of the droplet.

Preferably, an amount of displacement of the film member is equal to or less than ½ in terms of a loss of pressure generated by the actuator in order to discharge the droplet.

Preferably, a number of the pressure determination devices provided on a liquid supply side of a flow channel connected to n of the pressure chambers is equal to or greater than one and less than n, where n is an integer of two or more.

By adopting a composition in which a number of pressure determination devices less than n are provided in a common supply side flow channel that is connected to n pressure chambers, it is possible to determine the discharge status of n nozzles.

Preferably, the supply flow channel is formed in such a manner that a cross-sectional area of the supply flow channel reduces as the supply flow channel progresses in a downstream direction.

By adopting a composition in which the cross-sectional area of the flow channel reduces gradually in the downstream direction of the liquid flow, the flow rate becomes faster toward the downstream side and the possibility of removing air bubbles is increased. Furthermore, although the distance from the film member increases, the further the channel extends downstream, by making the cross-sectional area of the flow channel reduce gradually, it is possible to reduce attenuation of pressure waves and hence increase determination accuracy.

Preferably, the pressure determination device comprises a displacement restriction device which restricts the amount of displacement of the film member.

In order to attain the aforementioned object, the present invention is also directed to a discharge determination method for determining discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the method comprising the steps of: providing a film member inside at least one of the pressure chamber and the supply flow channel, so as to form a portion of a face constituting the one of the pressure chamber and the supply flow channel, the film member being displaceable in accordance with pressure change in the liquid inside the one of the pressure chamber and the supply flow channel; acquiring a determination signal corresponding to displacement of the film member; and judging the discharge status of the nozzle according to the determination signal obtained in accordance with driving of the actuator.

Furthermore, a droplet discharge apparatus comprising the discharge determination device according to the present invention is suitable for use as an image forming apparatus, such as an inkjet apparatus. For example, a discharge head, which is one mode of a droplet discharge apparatus, may be an inkjet recording head having a nozzle surface in which a plurality of nozzles for discharging ink droplets are arranged in a two-dimensional configuration, this head being used in an image forming apparatus comprising a conveyance device which causes the discharge head and a recording medium to move relative to each other by conveying at least one of the discharge head and the recording medium.

In this case, the shape of the recording head is not particularly limited, and the recording head may be a full-line recording head having nozzle rows in which a plurality of nozzles for discharging ink are arrayed across a length that corresponds to the entire width of the recording medium in a direction that is substantially orthogonal to the feed direction of the recording medium.

A "full-line recording head (droplet discharging head)" is normally disposed along the direction orthogonal to the relative feed direction (direction of relative movement) of the printing medium, but also possible is an aspect in which the recording head is disposed along the diagonal direction given a predetermined angle with respect to the direction orthogonal to the feed direction. The array form of the nozzles in the recording head is not limited to a single row array in the form of a line, and a matrix array composed of a plurality of rows is also possible. Also possible is an aspect in which a plurality of short-length recording head units having a row of nozzles that do not have lengths that correspond to the entire width of the printing medium are combined, whereby the image-recording element rows are configured so as to correspond to the entire width of the printing medium, with these units acting as a whole.

The "recording medium" is a medium (an object that may be referred to as a print medium, image formation medium, recording medium, image receiving medium, or the like) that receives images recorded by the action of the recording head and includes continuous paper, cut paper, seal paper, OHP sheets, and other resin sheets, as well as film, cloth, printed substrates on which wiring patterns or the like are formed with an inkjet recording apparatus, and various other media without regard to materials or shapes. In the present specification, the term "printing" expresses the concept of not only the formation of characters, but also the formation of images with a broad meaning that includes characters.

The term "moving device (conveyance device)" includes an aspect in which the printing medium is moved with respect to a stationary (fixed) recording head, an aspect in which the recording head is moved with respect to a stationary printing medium, or an aspect in which both the recording head and the printing medium are moved.

According to the present invention, since a pressure determination device using a film member is provided in at least one of a pressure chamber and a supply side flow channel connected to pressure chambers, the pressure change in the liquid being determined by means of this pressure determination device, then on the basis of this determination information, it is possible to judge not only the presence or absence of liquid, but also whether or not a state producing a discharge failure has occurred. Moreover, according to one mode of the present invention, since the pressure loss caused by displacement of the film member is designed so as to be within a range that does not affect discharge driving by the actuators or replenishment of the liquid, then it is possible to determine discharge during driving of the actuators, without reducing discharge functions.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus (Printer)

Figure 1:
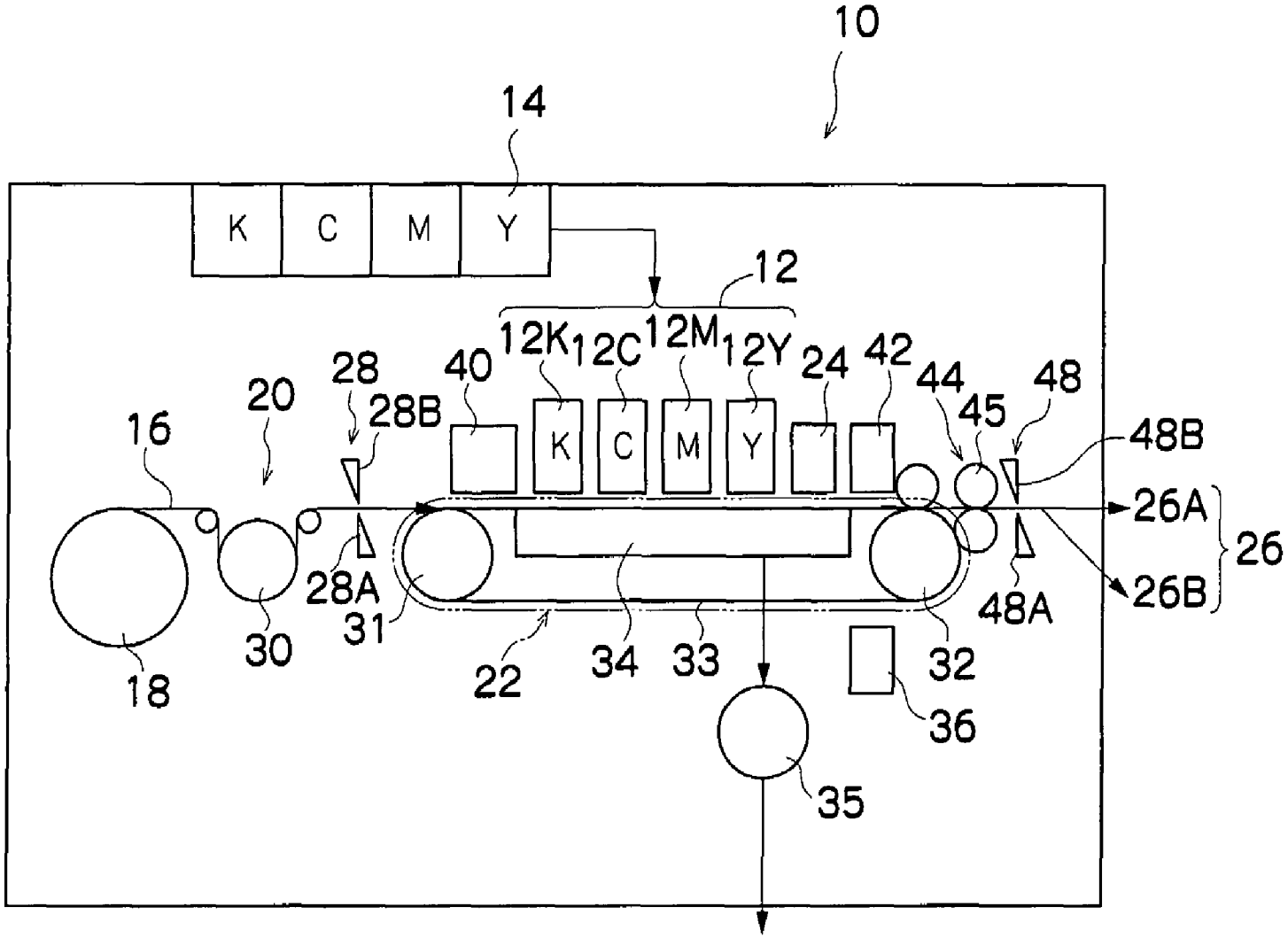
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; and a paper output unit 26 for outputting image-printed recording paper (printed matter) to the exterior.

The ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 114 (not shown in FIG. 1, but shown in FIG. 8) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
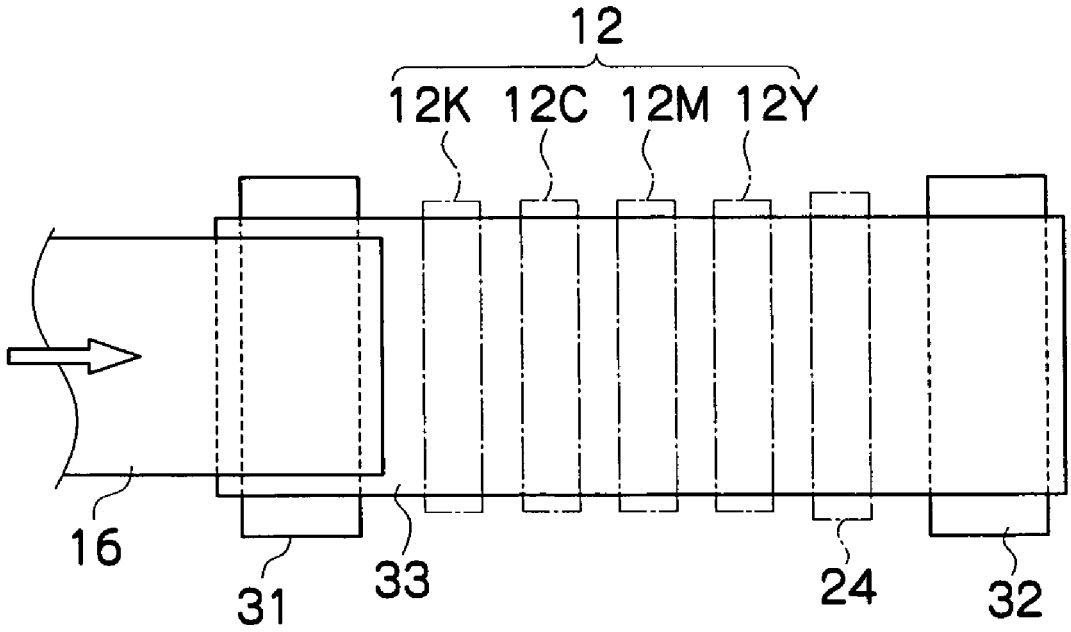
FIG. 2 is a plan view of principal components of an area around a printing unit of the inkjet recording apparatus in FIG. 1.

The printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2. A specific structural example of the print heads is described later with reference to FIGS. 3A to 5.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. In addition, the order of arranging the print heads 12K, 12C, 12M, and 12Y is not limited to those.

As shown in FIG. 1, the post-drying unit 42 is disposed following the printing unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively.

When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Print Head

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
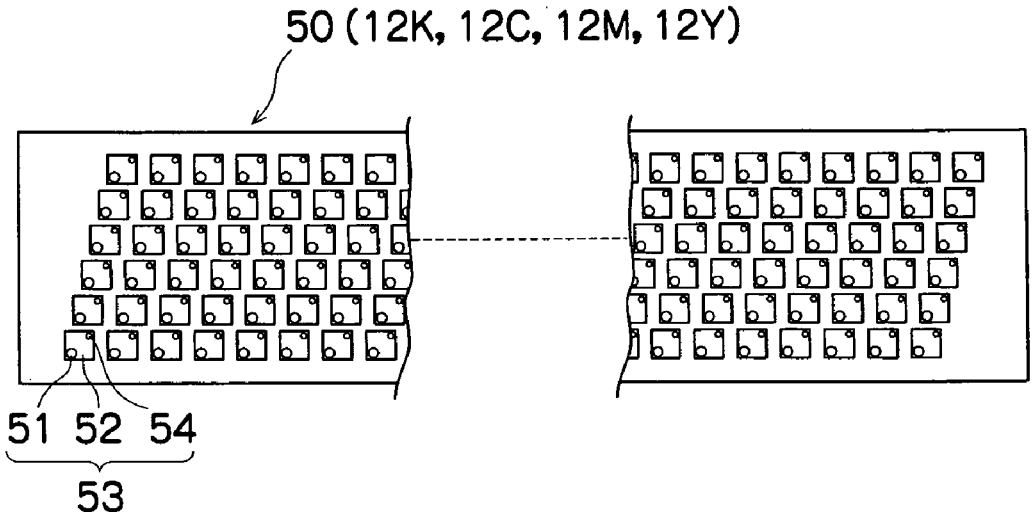
FIG. 3A is a perspective plan view showing an example of a configuration of a print head.
Figure 3B:
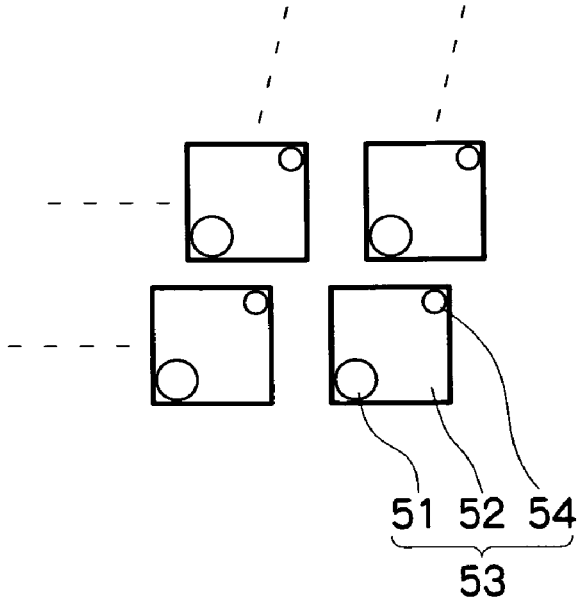
FIG. 3B is a partial enlarged view of FIG. 3A.
Figure 4:
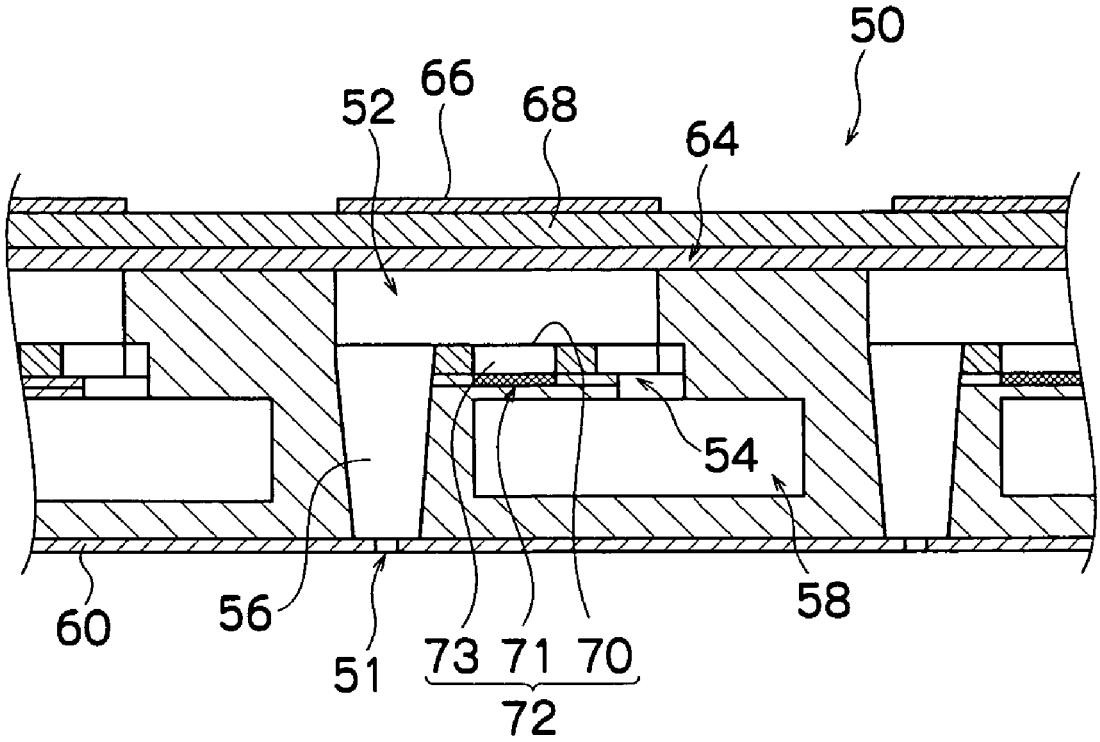
FIG. 4 is a cross-sectional view showing an example of an inner structure of a discharge element in the print head.

FIG. 3A is a perspective plan view showing an example of the configuration of the print head 50, FIG. 3B is an enlarged view of a portion thereof, and FIG. 4 is a cross-sectional view showing an example of an inner structure of a droplet discharge element (an ink chamber unit corresponding to a nozzle 51).

The nozzle pitch in the print head 50 should be minimized in order to maximize the density of the dots printed on the surface of the recording paper. As shown in FIGS. 3A, and 3B, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, the print head 50 in the present embodiment has one or more of nozzle rows in which the ink discharging nozzles 51 are arranged along a length corresponding to the entire width of the recording medium in the direction substantially perpendicular to the conveyance direction of the recording medium.

The planar shape of the pressure chamber 52 provided for each nozzle 51 is substantially a square, and the nozzle 51 and an ink inlet port (supply channel aperture) 54 are disposed in both corners on a diagonal line of the square. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

As shown in FIG. 4, a pressure chamber 52, a nozzle flow channel 56, a supply flow channel (common liquid chamber) 58, and the like, are formed inside the print head 50. A nozzle 51 forming a final restricting section through which the liquid is discharged is pierced through the nozzle plate 60, and the nozzle 51 connects to the pressure chamber 52 via the nozzle flow channel 56. Furthermore, the pressure chamber 52 is connected to the supply flow channel 58 by means via the supply channel aperture 54.

The supply flow channel 58 is connected to an ink tank 80 (not shown in FIG. 4, but shown in FIG. 7), which is a base tank that supplies ink, and the ink supplied from the ink tank 80 is delivered through the supply flow channel 58 to the pressure chambers 52.

As shown in FIG. 4, an actuator 68 provided with an individual electrode 66 is bonded to a diaphragm (pressure plate) 64, which forms a portion of the pressure chamber 52 (the upper face in FIG. 4). A piezoelectric body, such as a piezo element, is suitable as the actuator 68. When a drive voltage is applied to the individual electrode 66 corresponding to the pressure chamber 52, then the actuator 68 deforms, thereby changing the volume of the pressure chamber 52. This causes a pressure change which results in ink being discharged from the nozzle 51. When ink is discharged, new ink is filled into the pressure chamber 52 from the supply flow channel 58 through the supply channel aperture 54.

Although not illustrated in FIG. 4, there is a common electrode (film) in the border region between the diaphragm 64 and the actuator 68.

Furthermore, a pressure sensor 72 is provided inside the pressure chamber 52 which converts the displacement of the thin film 70 into an electrical signal and outputs same as a determination signal from a determination electrode (film displacement determination electrode) 71. The thin film 70 forms a part of the lower face of the pressure chamber 52 (namely, the face opposing the diaphragm 64 that is bonded to the actuator 68), and the surface of this thin film 70 which is opposite to the surface that contacts the ink faces onto a cavity 73 having a limited volume.

The pressure sensor 72 functions as a device for determining change in the ink volume and change in the ink pressure due to replenishment of ink, and the thin film 70 deforms in accordance with the ink volume and the ink pressure inside the pressure chamber 52. The amount of deformation of the thin film 70 (in other words, the displacement of the thin film) is converted into an electrical signal and output, whereby change in the ink volume and change in the ink pressure is determined.

The amount of deformation or displacement of the thin film 70 is not sufficient to affect the discharge of ink, and the thin film 70 has rigidity, or comprises a mechanism, which causes it to return to its original shape in such a manner that an ink replenishment force is generated when ink is replenished after discharge. The thin film 70 may be caused to return to its original shape naturally, due to its own tensile force, or a device may be provided which applies a returning force to the thin film 70.

A suitable device for applying a returning force may use electrostatic force, or the electromagnetic force generated by a coil or magnet. This can be achieved by making the structure functioning as a sensor also serve as an actuator. Thus, a returning force can be applied to the film by switching to an actuator function immediately after measuring the pressure.

Details of the pressure determination by means of the thin film 70 are described below, but the ink pressure upon driving of the actuator 68 is determined by means of a pressure sensor 72, and a judgment on whether or not a discharge failure has occurred (whether or not ink has been discharged normally) is made on the basis of the determination result from the pressure sensor 72.

Figure 5:
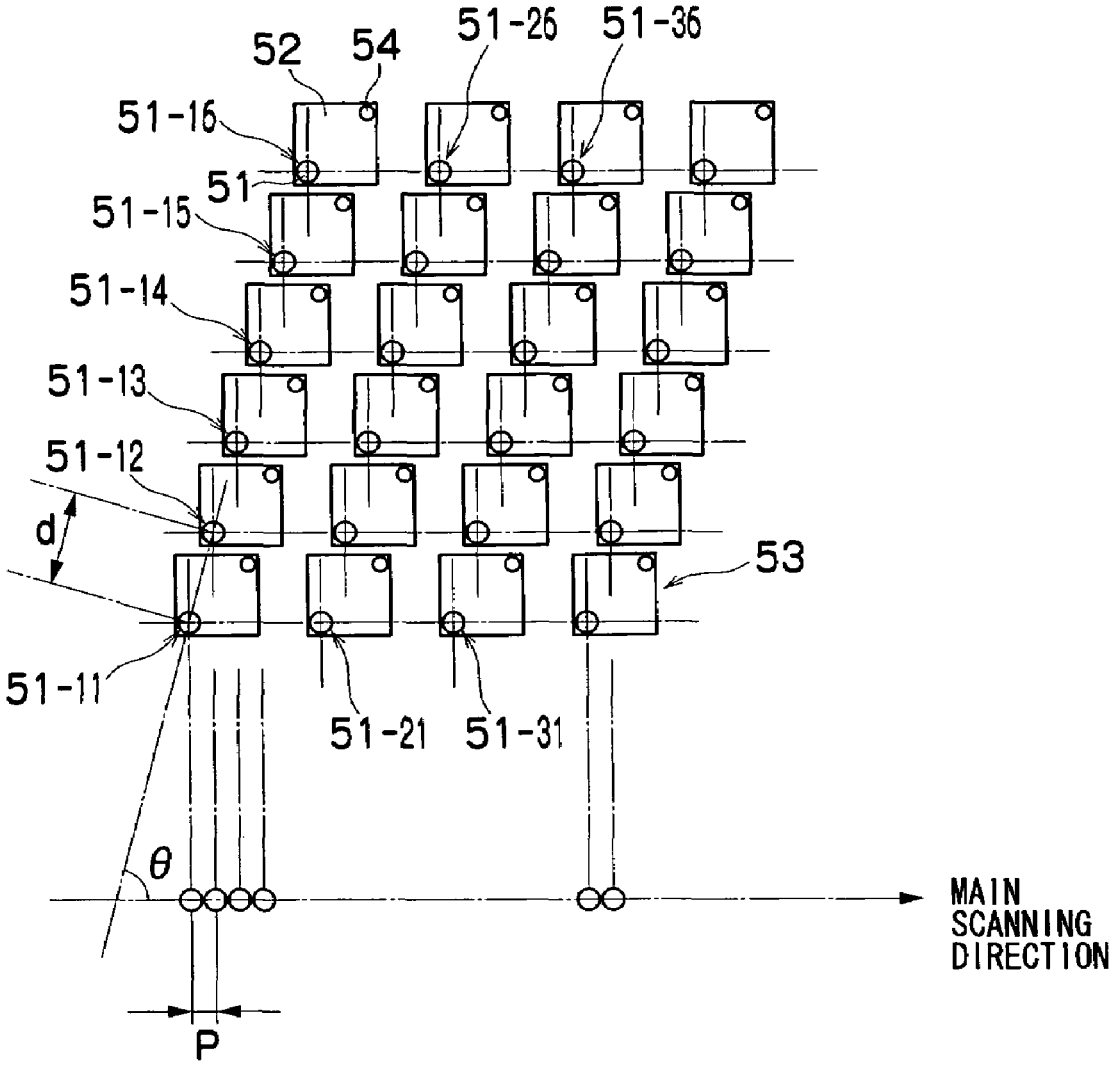
FIG. 5 is an enlarged view showing nozzle arrangement of the print head in FIG. 3.

The plurality of the liquid droplet discharge element 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which a plurality of rows of the liquid droplet discharge elements 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

Figure 6:
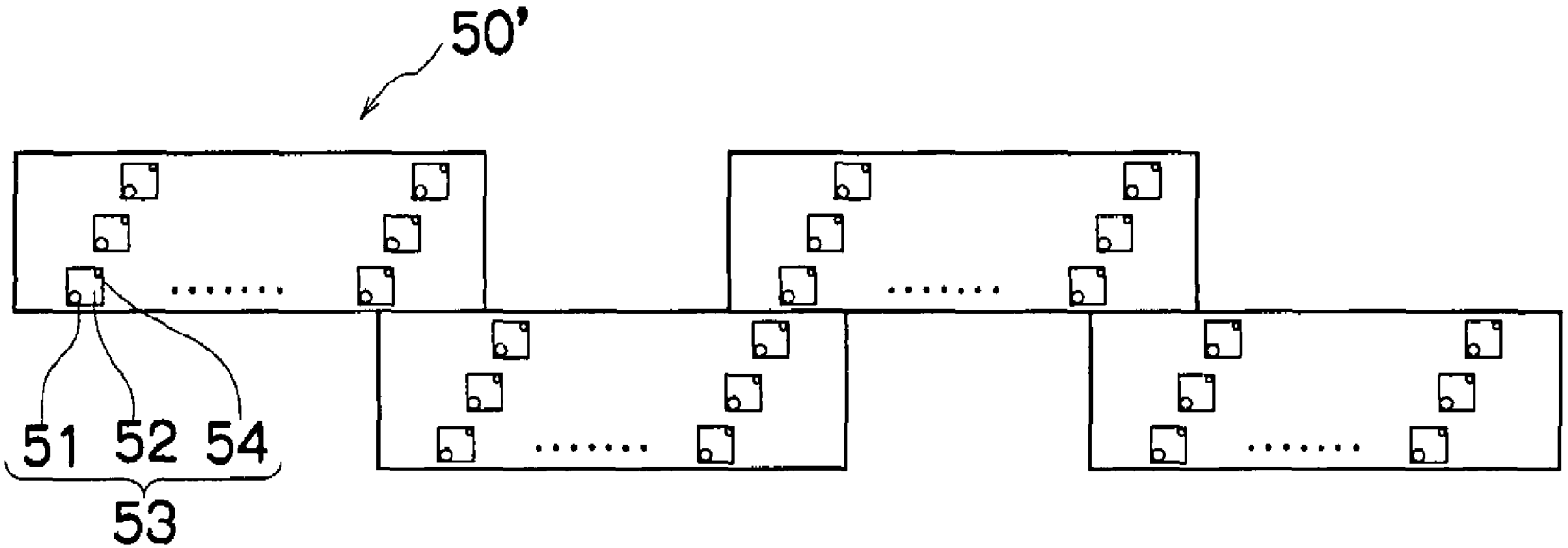
FIG. 6 is a perspective plan view showing another example of the configuration of the print head.

In implementing the present invention, the arrangement of the nozzles is not limited to that of the example illustrated as shown in FIGS. 3 through 5. For example, as shown in FIG. 6, a full-line head can be composed of a plurality of short two-dimensionally arrayed head units 50' arranged in the form of a staggered matrix and combined so as to form nozzle rows having lengths that correspond to the entire width of the recording paper 16.

Configuration of Ink Supply System

Figure 7:
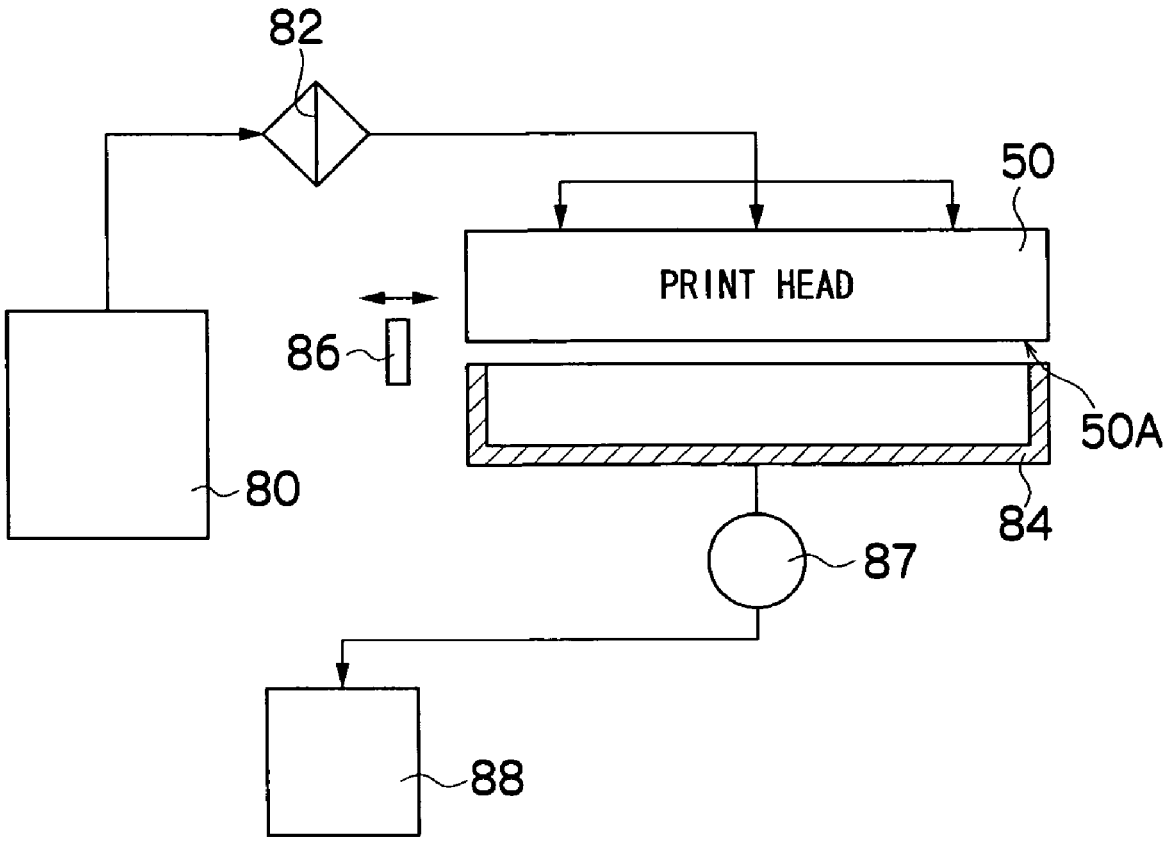
FIG. 7 is a schematic drawing showing a configuration of an ink supply system in the inkjet recording apparatus.

FIG. 7 is a schematic drawing showing the configuration of the ink supply system in the inkjet recording apparatus 10. An ink supply tank 80 is a base tank that supplies ink and is set in the ink storing and loading unit 14 described with reference to FIG. 1. The aspects of the ink supply tank 80 include a refillable type and a cartridge type: when the remaining amount of ink is low, the ink supply tank 80 of the refillable type is filled with ink through a filling port (not shown) and the ink supply tank 80 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 80 in FIG. 7 is equivalent to the ink storing and loading unit 14 in FIG. 1 described above.

A filter 62 for removing foreign matters and bubbles is disposed between the ink supply tank 80 and the print head 50 as shown in FIG. 7. The filter mesh size in the filter 62 is preferably equivalent to or less than the diameter of the nozzle and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 84 as a device to prevent the nozzles 51 from drying out or to prevent an increase in the ink viscosity in the vicinity of the nozzles 51, and a cleaning blade 86 as a device to clean a nozzle face 50A.

A maintenance unit (a restoring device) including the cap 84 and the cleaning blade 86 can be moved in a relative fashion with respect to the print head 50 by a movement mechanism (not shown), and is moved from a predetermined holding position to a maintenance position below the print head 50 as required.

The cap 84 is displaced up and down in a relative fashion with respect to the print head 50 by an elevator mechanism (not shown). When the power of the inkjet recording apparatus 10 is switched OFF or when in a print standby state, the cap 84 is raised to a predetermined elevated position so as to come into close contact with the print head 50, and the nozzle face 50A is thereby covered with the cap 84.

The cleaning blade 86 is composed of rubber or another elastic member, and can slide on the nozzle face 50A of the print head 50 (surface of the nozzle plate 60 shown in FIG. 4) of the print head 50 by means of a blade movement mechanism (not shown). When ink droplets or foreign matter has adhered to the nozzle plate 60, the surface of the nozzle plate 60 is wiped, and the surface of the nozzle plate 60 is cleaned by sliding the cleaning blade 86 on the nozzle plate 60.

During printing or standby, when the frequency of use of specific nozzles is reduced and ink viscosity increases in the vicinity of the nozzles, a preliminary discharge is made toward the cap 84 to discharge the degraded ink.

Also, when bubbles have become intermixed in the ink inside the print head 50 (inside the pressure chamber), the cap 84 is placed on the print head 50, ink (ink in which bubbles have become intermixed) inside the pressure chamber is removed by suction with a suction pump 87, and the suction-removed ink is sent to a collection tank 88. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the actuator 68 is operated. Before reaching such a state the actuator 68 is operated (in a viscosity range that allows discharge by the operation of the actuator 68), and the preliminary discharge is made toward the ink receptor to which the ink whose viscosity has increased in the vicinity of the nozzle is to be discharged. After the nozzle surface is cleaned by a wiper such as the cleaning blade 86 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 52, ink can no longer be discharged from the nozzles even if the actuator 68 is operated. Also, when the ink viscosity inside the nozzle 51 has increased over a certain level, ink can no longer be discharged from the nozzle 51 even if the actuator 68 is operated. In these cases, a suctioning device to remove the ink inside the pressure chamber 52 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary discharge is performed when the increase in the viscosity of the ink is small. The cap 84 described with reference to FIG. 7 serves as the suctioning device and also as the ink receptacle for the preliminary discharge.

Description of Control System

Figure 8:
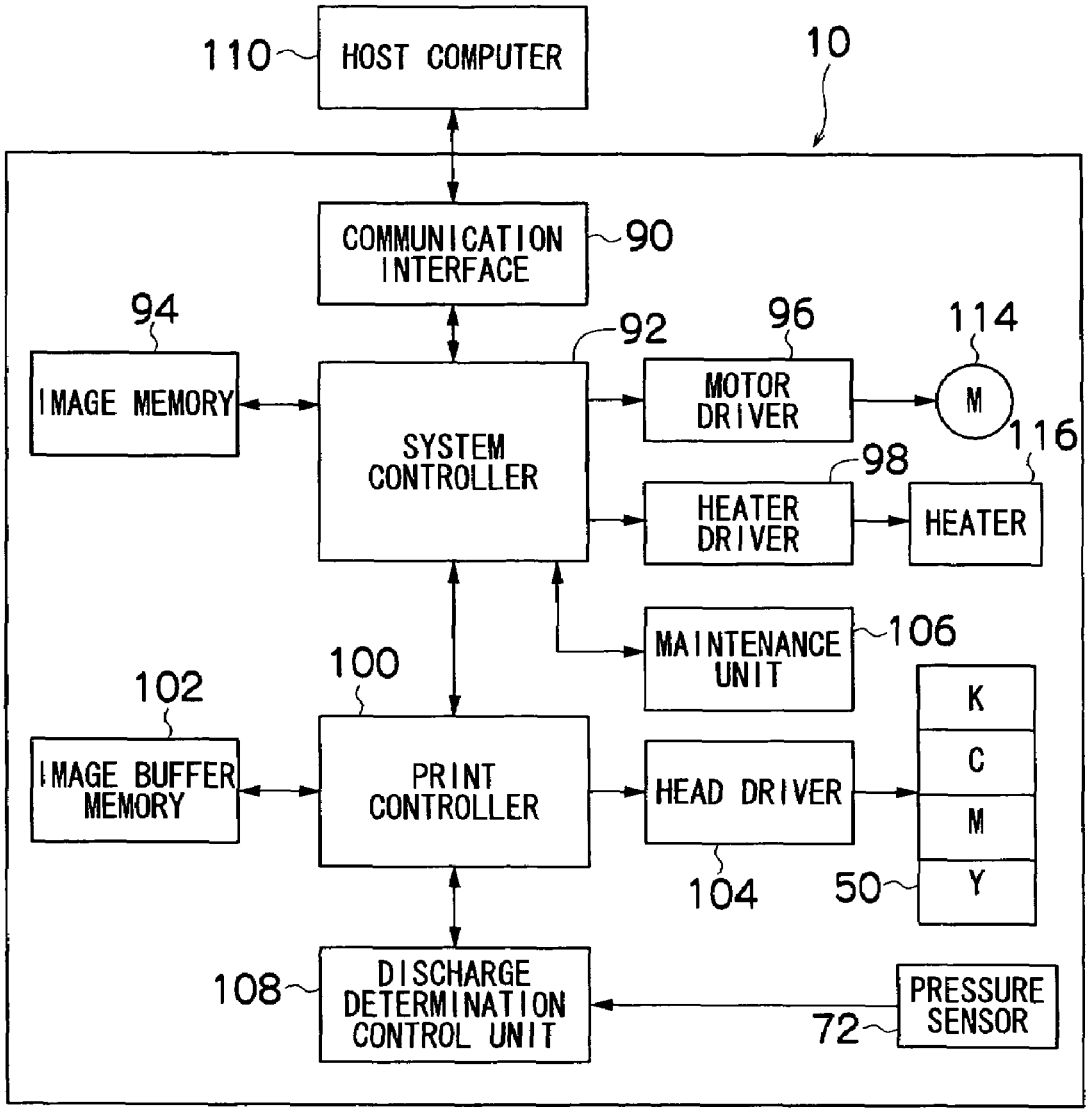
FIG. 8 is a principal block diagram showing the system composition of the inkjet recording apparatus.

FIG. 8 is a block diagram of the principal components showing the system configuration of the inkjet recording apparatus 10. The inkjet recording apparatus 10 has a communication interface 90, a system controller 92, an image memory 94, a motor driver 96, a heater driver 98, a print controller 100, an image buffer memory 102, a head driver 104, a maintenance unit 106, a discharge determination control unit 108, and other components.

The communication interface 90 is an interface unit for receiving image data sent from a host computer 106. A serial interface such as USB, IEEE1394, Ethernet, wireless network, or a parallel interface such as a Centronics interface may be used as the communication interface 90. A buffer memory (not shown) may be mounted in this portion in order to increase the communication speed.

The image data sent from the host computer 106 is received by the inkjet recording apparatus 10 through the communication interface 90, and is temporarily stored in the image memory 94. The image memory 94 is a storage device for temporarily storing images inputted through the communication interface 90, and data is written and read to and from the image memory 94 through the system controller 92. The image memory 94 is not limited to a memory composed of a semiconductor element, and a hard disk drive or another magnetic medium may be used.

The system controller 92 controls the communication interface 90, image memory 94, motor driver 96, heater driver 98, and other components. The system controller 92 has a central processing unit (CPU), peripheral circuits therefor, and the like. The system controller 92 controls communication between itself and the host computer 106, controls reading and writing from and to the image memory 94, and performs other functions, and also generates control signals for controlling a motor 114 and a heater 116 in the conveyance system.

The motor driver (drive circuit) 96 drives the motor 108 in accordance with commands from the system controller 92. The heater driver (drive circuit) 98 drives the heater 109 of the post-drying unit 42 or the like in accordance with commands from the system controller 92.

The print controller 100 has a signal processing function for performing various tasks, compensations, and other types of processing for generating print control signals from the image data stored in the image memory 94 in accordance with commands from the system controller 92 so as to apply the generated print control signals (image formation data) to the head driver 104. The print control unit 100 is a control unit having a signal processing function for performing various treatment processes, corrections, and the like, in accordance with the control implemented by the system controller 92, in order to generate a signal for controlling printing, from the image data in the image memory 94, and it supplies the print control signal (image data) thus generated to the head driver 104. Prescribed signal processing is carried out in the print control unit 100, and the discharge amount and the discharge timing of the ink droplets or the protective liquid from the respective print heads 50 are controlled via the head drier 104, on the basis of the image data. By this means, prescribed dot size, dot positions, or coating of protective liquid can be achieved.

The print controller 100 is provided with the image buffer memory 102; and image data, parameters, and other data are temporarily stored in the image buffer memory 102 when image data is processed in the print controller 100. The aspect shown in FIG. 8 is one in which the image buffer memory 102 accompanies the print controller 100; however, the image memory 94 may also serve as the image buffer memory 102. Also possible is an aspect in which the print controller 100 and the system controller 92 are integrated to form a single processor.

The head driver 104 drives the actuators 68 for the print heads 12K, 12C, 12M and 12Y of the respective colors on the basis of the print data received from the print controller 100. A feedback control system for keeping the drive conditions for the print heads constant may be included in the head driver 104.

The image data to be printed is externally inputted through the communications interface 90, and is stored in the image memory 94. At this stage, RGB image data is stored in the image memory 94, for example. The image data stored in the image memory 94 is sent to the print controller 100 through the system controller 92, and is converted to the dot data for each ink color by a known dithering algorithm, random dithering algorithm or another technique in the print controller 100.

The print head 50 is driven on the basis of the dot data thus generated by the print controller 100, so that ink is discharged from the head 50. By controlling ink discharge from the print head 50 in synchronization with the conveyance speed of the recording paper 16, an image is formed on the recording paper 16.

The discharge determination control unit 108 comprises a signal processing circuit which processes the determination signal from the pressure sensor 72 provided inside the print head 50, and it supplies the determination result obtained from the pressure sensor 72 to the print controller 100.

The print controller 100 and the system controller 92 judge whether or not the nozzles 51 have discharged, on the basis of the determination information obtained via the discharge determination control unit 108, and if they detect that a nozzle that has not discharged, then they implement control for performing a prescribed restoring operation or for correcting droplet ejection, or the like.

The maintenance unit 106 is a block which includes a cap 84, cleaning blade 86, and the like, as illustrated in FIG. 7. The maintenance unit 106 carries out required restoring processes in accordance with instructions from the system controller 92.

Discharge Determination Method

Next, a method for determining discharge in the inkjet recording apparatus 10 having the composition described above will be explained.

Figure 9:
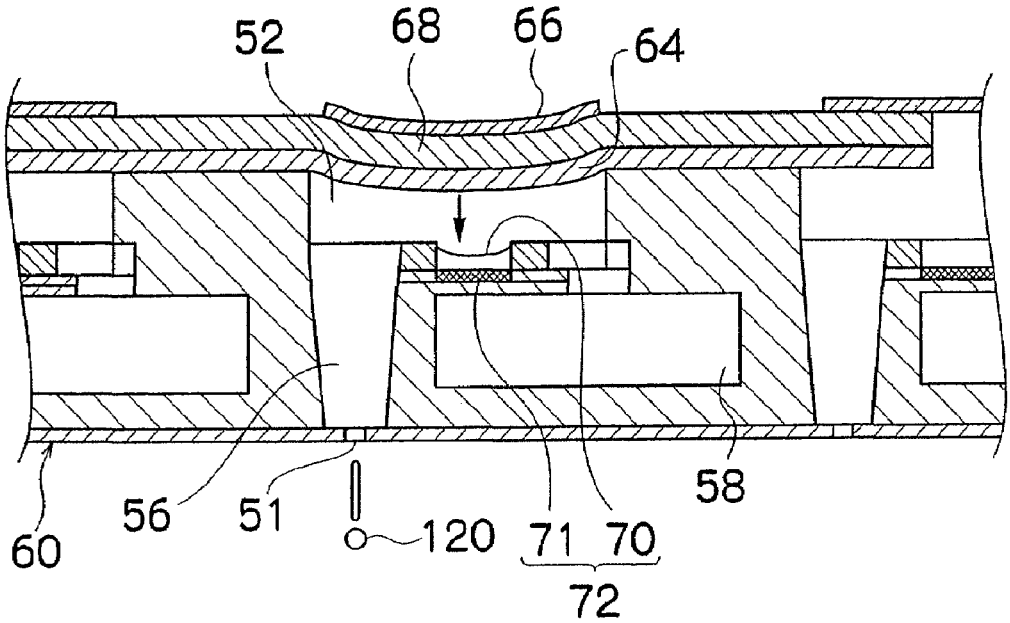
FIG. 9 is a cross-sectional diagram showing the state of deformation of a thin film during discharge.

FIG. 9 is a schematic drawing of a state where normal discharge is performed. As shown in FIG. 9, when a drive voltage is applied to the individual electrode 66 and the actuator 68 is caused to deform, the diaphragm 64 is displaced, the pressure chamber 52 deforms, and the ink inside the pressure chamber 52 is pressurized. In this way, an ink droplet 120 is discharged from the nozzle 51 due to the pressure generated by the actuator 68. At the same time, the thin film 70 of the pressure sensor 72 situated inside the pressure chamber 52 is also displaced.

Figure 10:
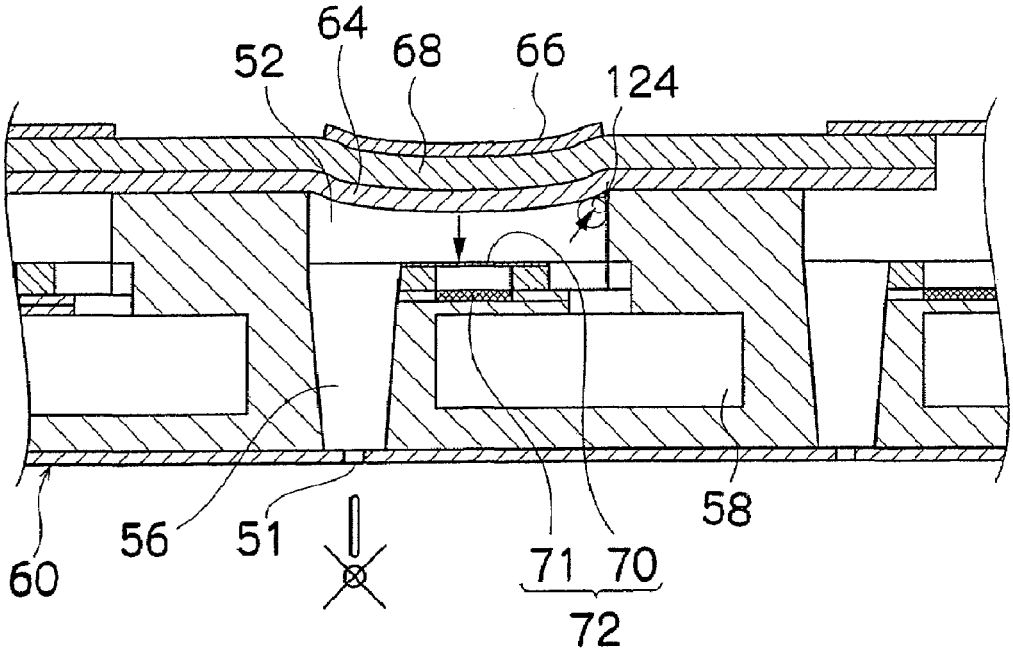
FIG. 10 is a cross-sectional diagram showing a state producing a discharge failure due to the presence of an air bubble inside the pressure chamber, and it illustrates an example of the relationship between a nozzle under inspection and a determination light beam.

On the other hand, if, as shown in FIG. 10 for example, there is an air bubble 124 present inside the pressure chamber 52, creating a state producing a discharge failure, then the pressure generated by the actuator 68 is absorbed by the contraction of the air bubble 124, ink is not discharged, and hence the displacement of the thin film 70 in the pressure sensor 72 is smaller than that in the case illustrated in FIG. 9.

By acquiring a determination signal corresponding to the amount of displacement of the thin film 70, from the determination electrode 71, information relating to the ink pressure is obtained. On the basis of this pressure information, a judgment is made regarding whether or not an air bubble 124 which would cause a discharge failure is present, in other words, whether a discharge failure is produced, or whether or not normal discharge is possible.

For the thin film 70 that is movable in accordance with the ink pressure, it is possible to use various metallic materials, such as stainless steel, gold, silver, platinum, or aluminum alloy, a semiconductor material, such as silicon or germanium, or a resin material, such as polyimide, Kevlar, polyester, polysulfone, or the like.

The material to be used is determined by taking a comprehensive view considering various factors, such as the required displacement with respect to the generated pressure, as well as the relationship of the material with the ink, namely, its suitability in terms of durability against corrosion, ink leaking characteristics during ink replenishment, compatibility with the manufacturing methods and materials used in the other sections of the head, and so on.

In the present embodiment, desirably, in order to achieve satisfactory pressure determination without affecting ink discharge, the amount of deformation or displacement of the thin film 70 is set to ½ or less in terms of a loss of the pressure generated by the actuator 68 for discharging ink. More specifically, taking $\delta P_1$ to be the pressure increase inside the pressure chamber 52 when the actuator 68 is displaced by a prescribed amount, in a case where the thin film 70 according to the present invention is not present, and $\delta P_2$ to be the corresponding pressure increase inside the pressure chamber 52 in a case where the thin film 70 is present, the following relationship, Formula 1is established:

$$\delta P_2/\delta P_1 \geqq 1/2. \quad (1)$$

Moreover, taking the deformation or displacement volume of the thin film 70 to be $V_2$, and the removed volume of the pressure chamber 52 generated by driving of the actuator 68 during ink discharge to be $V_1$ (namely, the volume of the deformation created when the actuator 68 seeks to push out ink from the pressure chamber 52), it is desirable that the following relationship, Formula 2 be satisfied:

$$V_2/V_1 \leqq 1/2. \quad (2)$$

Further, taking the volume of the ink returning from the pressure chamber 52 to the flow channel on the ink supply side (the supply flow channel 58) when ink is discharged to be $V_4$, it is desirable that the following relationship, Formula 3 be satisfied:

$$(V_2+V_4)/V_1 \leqq 1/2. \quad (3)$$

More preferably, the following relationship, Formula 4 is satisfied:

$$V_4 > V_2; \quad (4)$$

and furthermore preferably, the following relationship, Formula 5 is satisfied:

$$V_4 \times 0.25 > V_2. \quad (5)$$

Viewed from a different perspective, taking the volume of the ink flowing from the pressure chamber 52 to the discharge nozzle side (in the direction of the nozzle flow channel 56 and the nozzles 51) to be $V_3$, then it is desirable that the following relationship, Formula 6 be satisfied:

$$(V_2+V_3)/V_1 \leqq 1/2. \quad (6)$$

More preferably, the following relationship, Formula 7 is satisfied:

$$V_3 > V_2; \quad (7)$$

and furthermore preferably, the following relationship, Formula 8 is satisfied:

$$V_3 \times 0.25 > V_2. \quad (8)$$

In designing an inkjet head based on a normal piezo drive system, the ink volume flowing into the nozzle side for ink discharge in relation to the removed volume created by the actuator and the ink volume returning to the ink supply side are set so as to be approximately the same. This is in order that ink replenishment is carried out swiftly, while maintaining the discharge amount or discharge velocity as high as possible.

The conditions indicated in the above-described Formulas (2) to (5) are established in order that, even if a pressure determination function is added, a discharge amount and discharge velocity of a similar level to those in a case where no determination function is provided can be obtained. In this case, the deposition accuracy and the droplet size are prioritized over the drive frequency of the head.

On the other hand, the conditions indicated in the above-described Formulas (6) to (8) are established in order that, even if a pressure determination function is added, ink replenishment characteristics of a similar level to those in a case where no determination function is provided can be obtained. In this case, the driving of the head at a high frequency is emphasized, for instance, when using high-viscosity ink which is difficult to replenish.

Furthermore, the coefficient of "×0.25" in Formulas (5) and (8) is determined on the basis of experimental values for the variation in the manufacturing accuracy of the flow channel and the variation in the discharge phenomenon, and provided that it is equal to or below this value, then the effects on the pressure determination can be ignored. If the loss is approximately 12.5% of the removed volume finally, then it can be ignored in the discharge action, and provided that this condition is satisfied, then there will be no effect on the discharge/refill characteristics.

From the objective of achieving accurate pressure determination, it is necessary to compose the thin film 70 in such a manner that it is readily displaceable, but it is not desirable that the thin film 70 be displaced more than necessary, since this causes the loss of discharge pressure to increase. Furthermore, conversely, if the rigidity of the thin film 70 is increased excessively in order to suppress loss of the discharge pressure, the determination sensitivity will fall. Therefore, a desirable mode is one in which a stopper mechanism is provided which restricts the displacement of the thin film 70, appropriately.

Figure 11A:
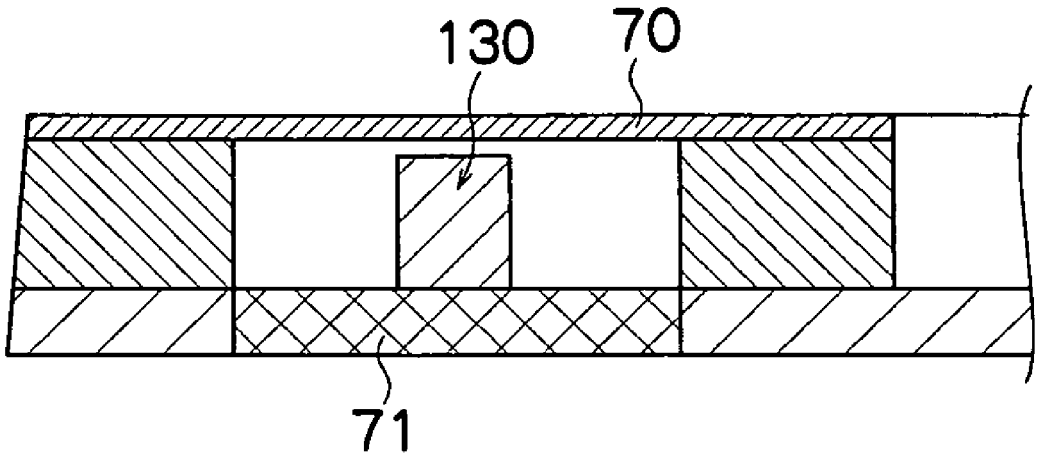
FIG. 11A is a cross-sectional diagram showing a state where a stopper for restricting the amount of displacement of the thin film is provided.
Figure 11B:
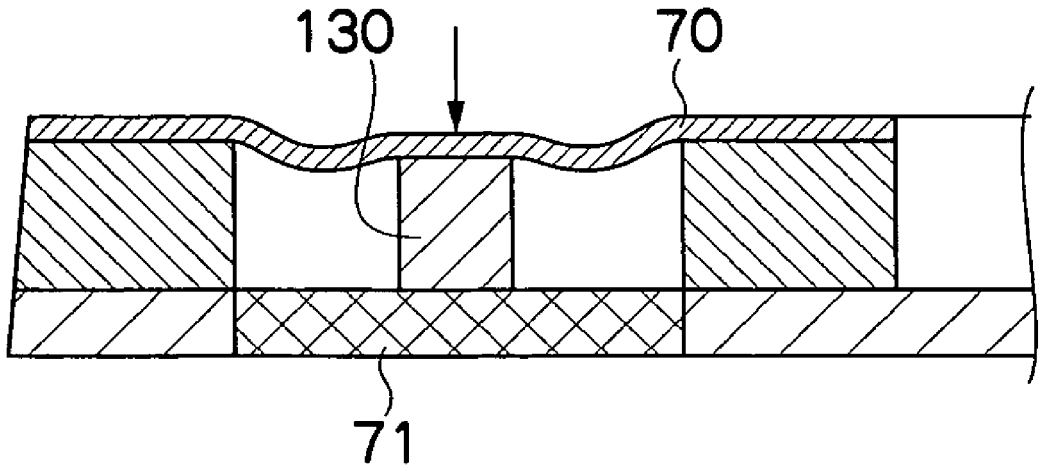
FIG. 11B is a cross-sectional diagram showing the action of the stopper.

FIGS. 11A and 11B show a first example of a stopper mechanism which restricts the displacement of the thin film. In the example shown in FIGS. 11A and 11B, the thin film 70 is a flat planar shape, and a cylindrical projection 130 is provided in the surface which opposes the thin film 70 (namely, the upper face of the determination electrode 71 in FIGS. 11A and 11B). This projection 130 is arranged at a suitable interval from the thin film 70, as required for the purpose of determining pressure. The thin film 70 is displaced from the state shown in FIG. 11A, and as shown in FIG. 11B, when the thin film 70 makes contact with the upper face of the projection 130, the thin film 70 becomes unable to be displaced any further.

The shape of the projection 130 is not limited to being a cylinder, and it may also be a shape having a rounded, projecting contact section, or a shape having a sunken depression that matches the deformation of the film. Moreover, the distance between the film and the surface opposing the film may also be set to the interval required for pressure determination as described above. However, if a gas is introduced between the film and the opposing surface, then the contractive properties of the gas will act as a spring that impedes the displacement of the film. Therefore, it is desirable that a hole for expelling the gas is provided in a position other than the film.

Figure 12:
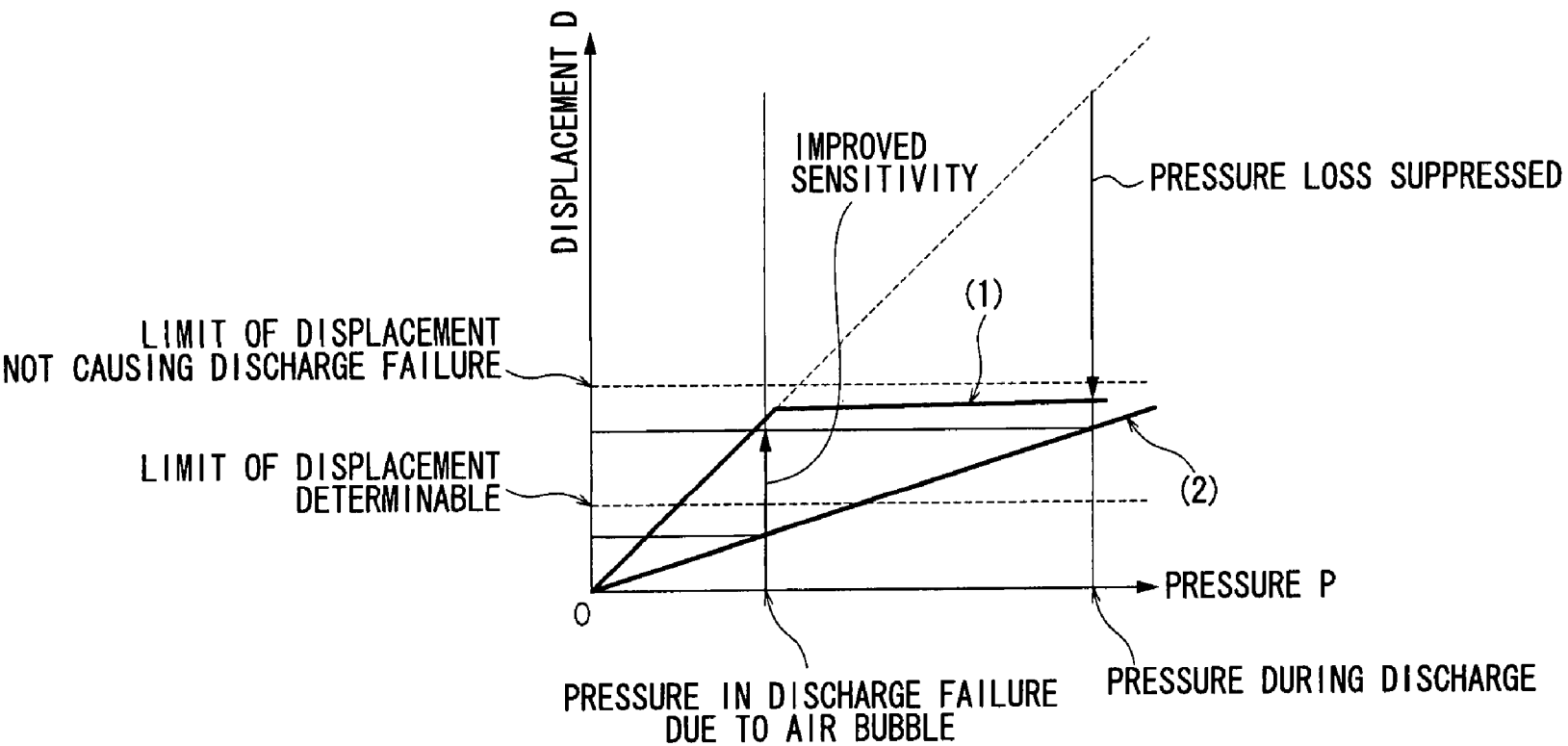
FIG. 12 is a graph showing the relationship between pressure and the displacement of the thin film.

FIG. 12 shows graphs of the relationship between the pressure and the displacement of the film. Graph (1) is an example where a stopper mechanism as described in FIGS. 11A and 11B is provided. Graph (2) in FIG. 12 is an example in which no stopper mechanism is provided. As shown in graph (1), in the case of the structure having the stopper mechanism, the displacement of the film with respect to the pressure change is highly sensitive up until a pressure sufficient in order to determine an abnormality. Thereafter, it is possible to suppress further displacement under the pressure that is normally reached. In other words, a beneficial effect is obtained in that the loss in the pressure required for discharge is reduced. On the contrary, supposing that the film is made of a highly rigid material that is not liable to be displaced, and that no stopper mechanism is used, then although there is little loss during discharge, as illustrated by graph (2), the displacement in the event of an abnormality is also small and therefore high-sensitivity determination cannot be achieved.

Therefore, it is possible to achieve more satisfactory determination by achieving the determination characteristics shown in graph (1) by using a stopper mechanism.

Figure 13:
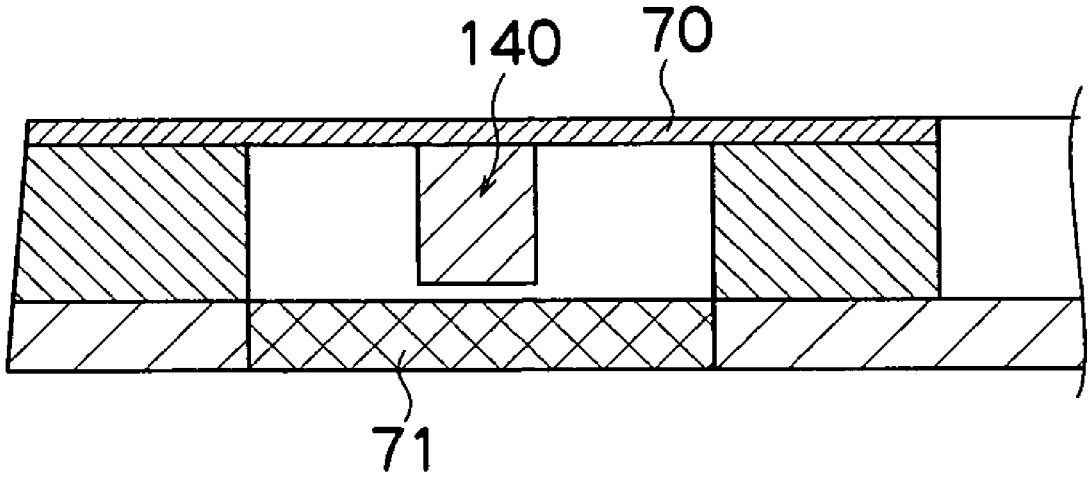
FIG. 13 is a cross-sectional diagram showing an example in which a stopper is provided on the thin film.

FIG. 13 shows a second example of a stopper mechanism which restricts the displacement of the thin film. More specifically, FIG. 13 is an example in which a stopper projection 140 is provided on the thin film 70. The projection 140 is bonded to the lower surface of the thin film 70 and by means of the lower face of the projection 140 abutting against the determination electrode due to displacement of the thin film 70, a structure which impedes further displacement is achieved.

Figure 14A:
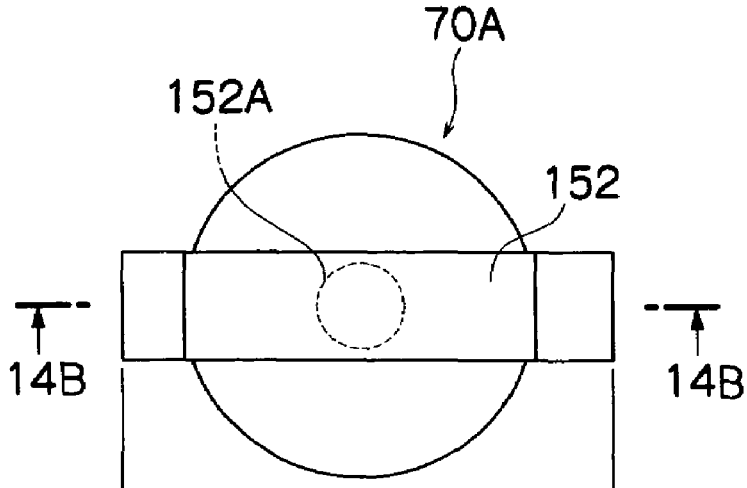
FIGS. 14A and 14B are diagrams showing an example where stoppers are provided on either side of the thin film in the direction of displacement.
Figure 14B:
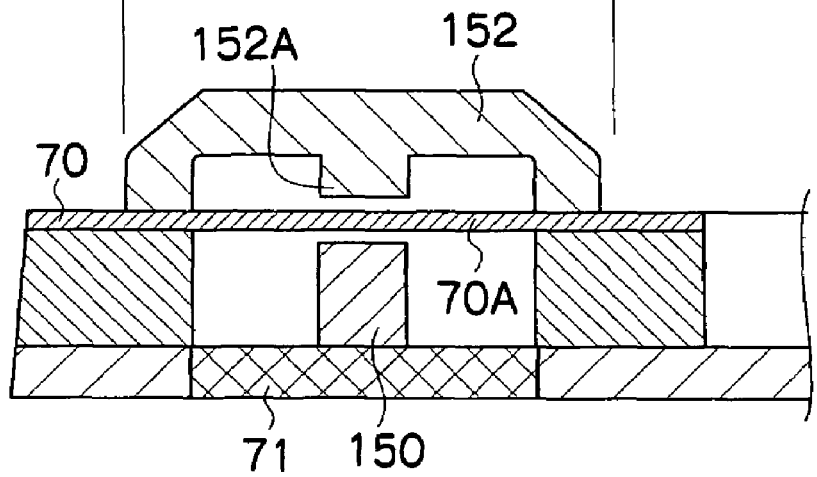

FIGS. 14A and 14B show a third example of a stopper mechanism for restricting the displacement of the thin film, wherein FIG. 14A is a plan view and FIG. 14B is a cross-sectional view along line 14B-14B in FIG. 14A. The composition shown in FIGS. 14A and 14B is an example where stopper members 150 and 152 are provided on upper and lower surfaces of the thin film 70, in order that the displacement of the thin film 70 can be restricted both in a situation of positive pressure and a situation of negative pressure. The stopper member 152 restricting the displacement of the thin film 70 in the upward direction in FIGS. 14A and 14B spans in an approximate arch shape over the effective movement region 70A of the thin film 70, and is formed with a projecting section 152A, which is a portion that makes contact with the thin film 70, located in a position corresponding to the lower stopper member 150, on the opposite side of the thin film 70 from same. By adopting this composition, it is possible to reduce pressure loss during ink replenishment, as well as during ink discharge.

Figure 15A:
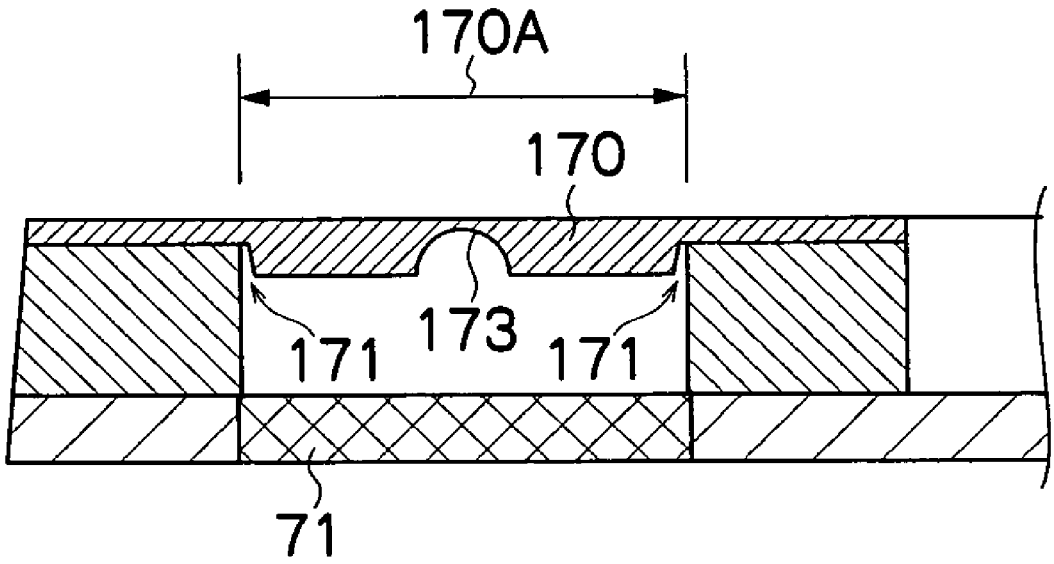
FIGS. 15A and 15B are cross-sectional diagrams showing an example where a stopper function is achieved by means of the shape of the thin film.
Figure 15B:
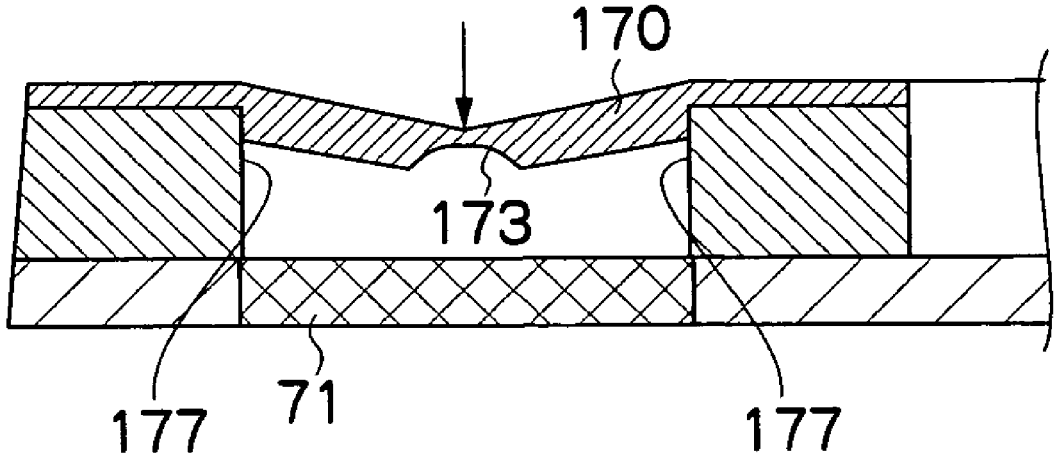

FIGS. 15A and 15B show a fourth example of a stopper mechanism which restricts the displacement of the thin film. FIGS. 15A and 15B show an example where the displacement is restricted by appropriately designing the cross-sectional shape of the film, without using a projecting stopper. In this example, narrow grooves 171 are formed in the thin film 170 at the edges of the effective movement region 170A, thereby reducing the thickness of the thin film 170 in these edge regions, and furthermore, a recess section 173 is formed in the central region of the thin film 170, thereby reducing the thickness in this region and making it more readily displaceable. The regions of the thin film 170 other than these are made from a relatively thick sheet, thereby forming a structure that is not readily displaceable (see FIG. 15A).

In this composition, if a pressure is applied to the thin film 70, then as shown in FIG. 15B, the regions of the perimeter grooves 171 are displaced and make contact with the side walls 177, thereby preventing any further displacement. Furthermore, if a structure such as that illustrated in FIGS. 15A and 15B is provided in symmetrical upper and lower positions in the film surfaces, then it becomes possible to restrict the displacement of the film in the cases of both positive pressure and negative pressure.

Possible methods for determining pressure include a method in which a capacitor is formed between the thin film 70 and the surface opposing same, and the pressure is determined on the basis of change in the electrostatic capacitance, a method in which a distortion gauge is formed in the thin film and the pressure is determined on the basis of the distortion of the film, or a method based on a composition in which the thin film 70 makes contact with an opposing projection, or the like, as shown in FIGS. 11A and 11B, FIG. 13 and FIGS. 14A and 14B, the contacting section being used as a switch.

For example, a possible mode is one in which the thin film 70 includes a dielectric body, and the deformation or displacement of the film is determined on the basis of the electrostatic capacitance. Furthermore, the deformation or displacement of the thin film 70 may also be determined on the basis of electrical resistance. Moreover, the thin film 70 may be made from a piezoelectric body and the pressure change may be determined by generating a voltage in accordance with the pressure. Apart from these modes, it is also possible to determine the displacement of the thin film 70 on the basis of the time taken to receive an echo of an ultrasonic wave, or by using a laser displacement meter.

Further Embodiments

Figure 16:
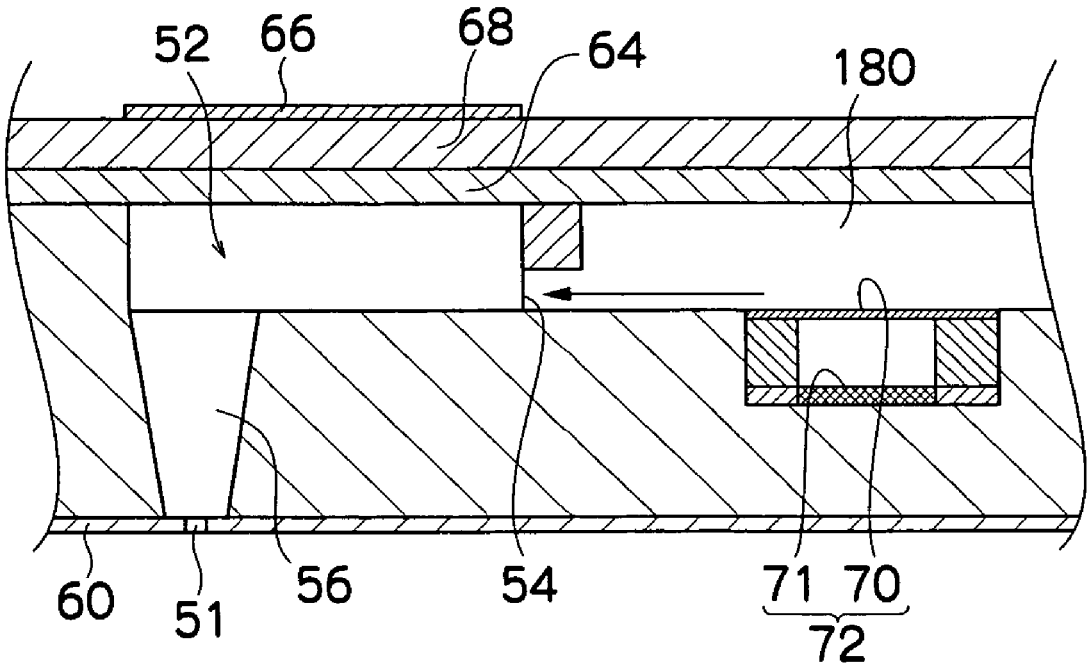
FIG. 16 is a cross-sectional diagram showing the internal structure of a print head according to a further embodiment of the present invention.

FIG. 16 is a cross-sectional diagram showing a further embodiment of the present invention. In FIG. 16, members which are the same as or similar to those in FIG. 4 are labeled with the same reference numerals and description thereof is omitted here. FIG. 4 shows an example in which a pressure sensor 72 is provided inside the pressure chamber 52. However, as shown in FIG. 16, it is also possible to adopt a mode in which a pressure sensor 72 is provided inside the ink supply channel 180 which connects to the pressure chamber 52.

More specifically, the print head 50 illustrated in FIG. 16 comprises a pressure sensor 72 which determines change in the ink volume and change in the ink pressure during ink discharge and ink replenishment, provided inside the ink supply channel 180 which connects to the pressure chamber 52. This pressure sensor 72 has a structure for determining the change in the ink volume and change in the ink pressure on the basis of the deformation and displacement of the thin film 70 which faces onto the flow channel of the ink supply channel 180. For the structure of the pressure sensor 72, it is possible to adopt a similar structure to that illustrated in the examples shown in FIG. 4, FIGS. 11A to FIG. 15B.

In this composition, desirably, in order to achieve satisfactory pressure determination without affecting ink discharge, the amount of deformation or displacement of the thin film 70 is set to ½ or less in terms of a loss of the pressure generated by the actuator 68 for discharging ink. Moreover, it is desirable that the deformation or displacement of the thin film 70 be set to ½ or less of the displacement volume caused by the actuator 68, when converted to the displacement volume.

Furthermore, the sum of the ink volume returning to the ink supply channel from the pressure chamber 52, plus the change in the volume of the ink supply channel 180 caused by displacement of the thin film 70, is set so as to be ½ or less of the removed volume generated by driving of the actuator during ink discharge.

Figure 17:
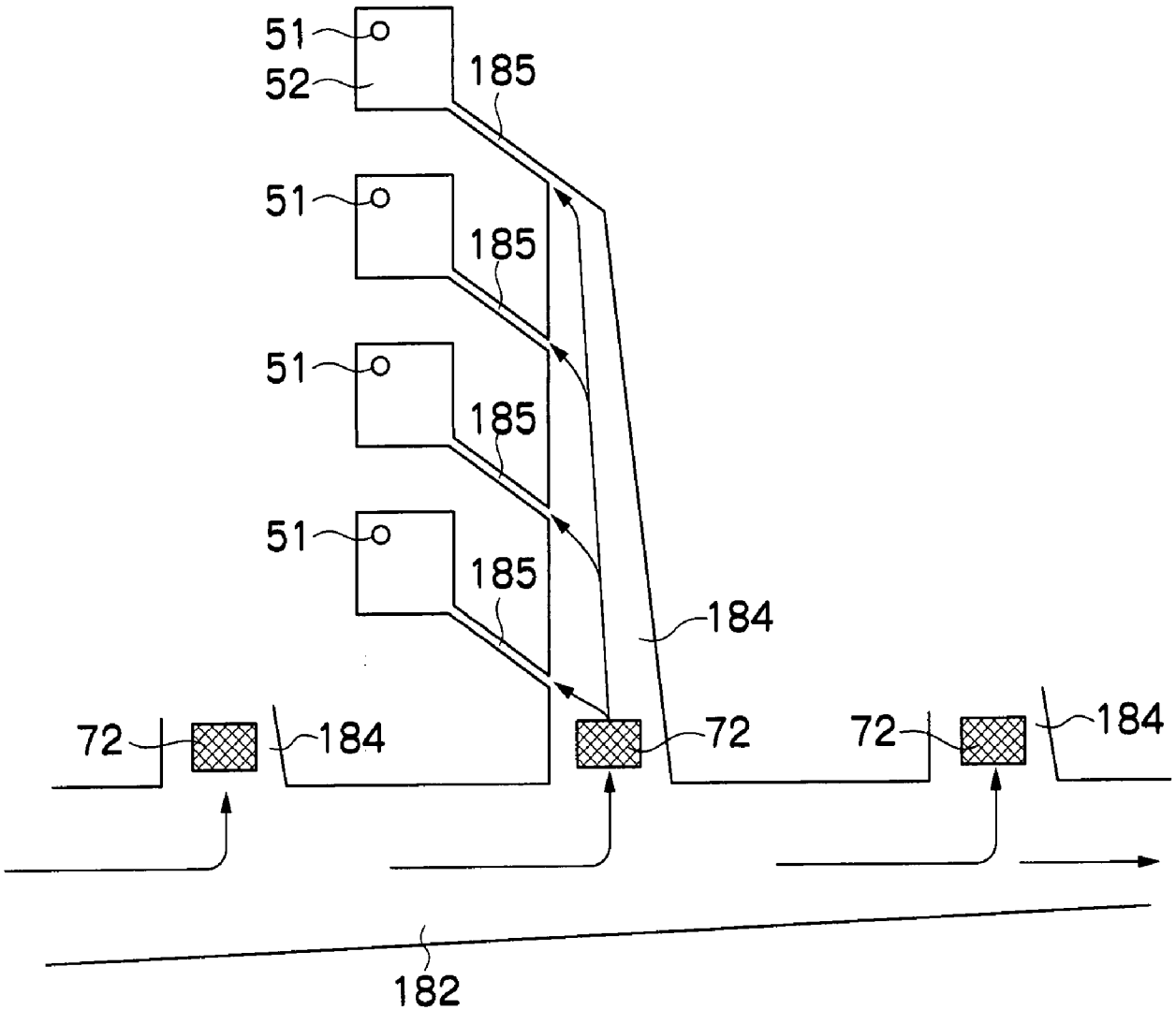
FIG. 17 is a plan view perspective diagram showing the principal part of an example of a flow channel composition in a print head.

FIG. 17 is a principal enlarged diagram of a plan perspective view of the print head 50 as viewed from above. In the diagram, numeral 182 denotes a trunk flow channel of the common flow channel. A plurality of branch channels (common flow channel branches) 184 divide off from the trunk flow channel 182. The common flow channel branches 184 each connect to a plurality of pressure chambers 52 (four pressure chambers in FIG. 17), via individual supply channels 185.

A pressure sensor 72 is provided in each of the common flow channel branches 184 that are connected to a plurality of pressure chambers 52 as described above, the pressure sensor 72 being positioned in the most upstream portion of the common flow channel branch where it divides from the base section (the trunk common supply channel 182). This one pressure sensor 72 determines the ink discharge status from the plurality of nozzles 51 located downstream from the pressure sensor 72. More specifically, during determination, ink is discharged sequentially from each of the plurality of nozzles 51, one by one. Alternatively, ink is discharged continuously by staggering the discharge timings at the respective nozzles. It is possible to specify a nozzle relating to a discharge abnormality on the basis of the determination signal corresponding to driving of the nozzles (a discharge operation).

FIG. 17 shows an example in which four pressure chambers 52 are connected to one common flow channel branch 184, but the number of pressure chambers and the locations of the pressure sensor 72 are not limited to the example in FIG. 17.

Taking a general view of the example of FIG. 17, it is possible to determine ink discharge from n (where n is an integer of 2 or greater) nozzles, by providing a number of pressure sensors 72 equal to or greater than 1 and less than n, on the ink supply side of a flow channel connected to n pressure chambers 52.

Furthermore, as shown in FIG. 17, in the common flow channel branch 184 connected to the plurality of pressure chambers 52, the cross-sectional area of the flow channel gradually reduces in the downstream direction of the ink flow.

If the common flow channel branch 184 is of uniform thickness, then the flow rate becomes slower as it progresses in the downstream direction. Therefore, if an air bubble occurs inside the common flow channel branch 184, it is difficult to remove that air bubble. Consequently, as shown in FIG. 17, a composition is adopted in which the cross-sectional area of the flow channel reduces toward the downstream side, thereby creating a structure which causes the ink flow speed to increase gradually as the ink travels in the downstream direction. This increases the possibility of removing air bubbles. Furthermore, since the distance from the pressure sensor 72 increases, the further the ink travels downstream, attenuation of the pressure wave can be expected. Therefore, in order to avoid attenuation, it is also desirable to adopt a composition in which the cross-sectional area of the flow channel reduces gradually toward the downstream side.

Similarly, in the trunk common flow channel 182, it is also desirable to adopt a composition in which cross-sectional area reduces gradually in the downstream direction of the ink flow. FIG. 17 shows a structure in which both the trunk common flow channel 182 and the common flow channel branches 184 are formed respectively with a continuously reducing cross-sectional area in the downstream direction of the ink flow. However, rather than a tapered flow channel structure of this kind, it is also possible to adopt a composition in which the cross-sectional area of the flow channels reduces in a stepwise fashion.

Naturally, in the structure shown in FIG. 17, the respective pressure chambers 52 connected to the same common flow channel branch 184 are located at respectively different distances from the pressure sensor 72 at the base end section of the common flow channel branch 184. Therefore, even if the nozzles 51 corresponding to these pressure chambers 52 perform discharge simultaneously, the respective pressure waves will take different times to reach the pressure sensor 72, and therefore discharge can be determined for each of the nozzles, even if they are discharged simultaneously. However, if the drive timings of the nozzles 51 are also staggered intentionally, as described above, then it is possible to increase the time differential between the pressure waves, and hence the pressure in a plurality of nozzles 51 can be measured even more accurately by means of a single pressure sensor 72.

Taking account of the time differentials which are dependent on the distance from the pressure sensor 72 to the pressure chambers 52, if continuous discharge is performed, then it is desirable that the nozzles are driven (and determined) sequentially, starting from the nozzle nearest to the pressure sensor 72.

Figure 18:
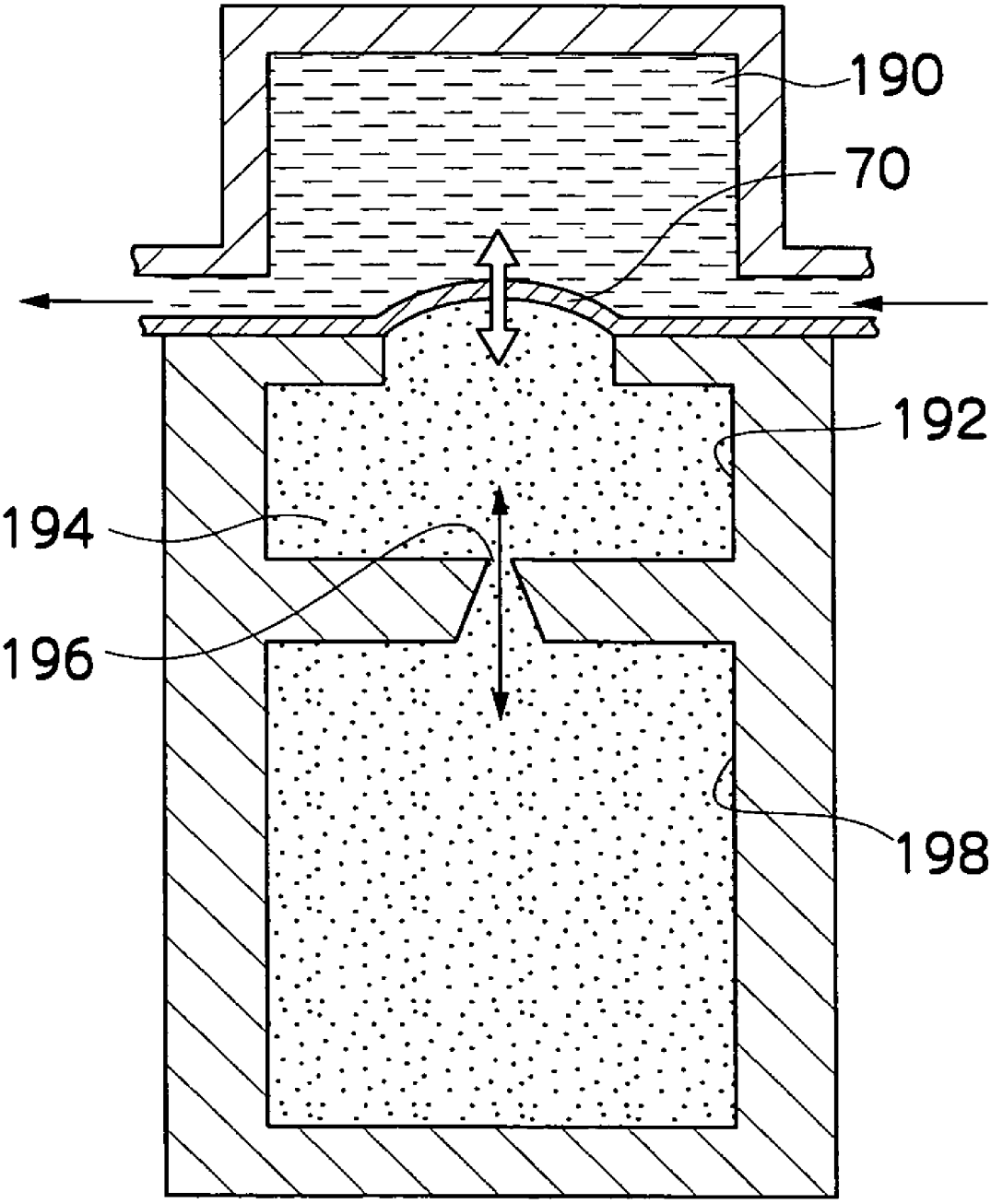
FIG. 18 is a schematic diagram showing a further example of the structure of a pressure sensor.

FIG. 18 is a schematic diagram showing a further example of the structure of a pressure sensor 72. The thin film 70 forms a part of the flow channel along with the ink 190 passes, and the opposite side of the thin film 70 to the ink 190 connects with a cavity 192 (hereafter, "first cavity"). A gas or liquid (hereafter, "fluid 194") is filled into this first cavity 192. This first cavity 192 connects with a further cavity 198 (hereafter, "second cavity") via a small hole 196, and the speed of deformation of the thin film 70 is regulated by the fluid 194 inside the first and second cavities 192 and 198 moving through the small hole 196. Furthermore, the second cavity 198 has a lower pressure than the first cavity 192 and has the action of returning the thin film to its initial position.

According to a structure of this kind, it is possible to restrict the natural movement of the thin film 70 by means of the fluid 194 inside the first and second cavities 192 and 198, thus suppressing unwanted vibrations in the ink 190 and stabilizing discharge yet further.

Furthermore, the thin film 70 in FIG. 18 is desirably set to have an intrinsic frequency and attenuation characteristics which cause it to function as a damper that suppresses ink vibrations during an ink discharge operation.

As a further modification example, it is also possible to adopt a structure in which the surface of the thin film 70 described in the various embodiments above that is opposite to the surface facing the pressure chamber 52 or the ink supply channel 180 is designed to face a separate ink flow channel, thereby achieving a structure in which both surfaces of the thin film 70 make contact with the ink. More specifically, for example, the portion corresponding to the first cavity 192 in FIG. 18 is used as an ink flow channel, thereby achieving a structure in which the speed of deformation of the thin film 70 is regulated by the ink flowing along this ink flow channel.

In the foregoing explanation, the inkjet recording apparatus 10 has been described, but the scope of application of the present invention is not limited to this. For example, the droplet discharge device according to the present invention may also be applied to a photographic image forming apparatus having a discharge head which coats developing solution, or the like, onto a printing paper by means of a non-contact method. Furthermore, the scope of application of the present invention is not limited to an image forming apparatus, and the present invention may also be applied to various other types of apparatus, such as a coating apparatus for coating a processing liquid or other liquid onto a medium by means of a discharge head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein the portion of the face constituting the pressure chamber that is formed by the film member is less than the entire face constituting the pressure chamber, the film member is spaced apart from at least a portion of the pressure chamber to which the actuator is joined, the film member forms the portion of the face constituting the pressure chamber that differs from another face of the pressure chamber which is formed by the portion of the pressure chamber to which the actuator is joined, and the droplet of liquid is discharged from the nozzle in a direction in which the film member is displaced.

2. The discharge determination device as defined in claim 1, wherein the film member is displaceable within a range of displacement which allows the liquid to be discharged by driving of the actuator.

3. The discharge determination device as defined in claim 1, wherein the film member is constituted in such a manner that the film member reverts to an initial state of the film member upon replenishment of the liquid into the pressure chamber after the discharge of the droplet.

4. The discharge determination device as defined in claim 1, wherein a ratio of pressure inside the pressure chamber when the actuator is displaced by a prescribed amount in a case where the film member is present to a pressure inside the pressure chamber if the film member were not present and when the actuator has been displaced by the prescribed amount is greater than or equal to ½.

5. The discharge determination device as defined in claim 1, wherein a displacement volume of the film member is equal to or less than ½ of a removed volume of the pressure chamber caused by the actuator.

6. The discharge determination device as defined in claim 1, wherein a sum of a volume of the liquid returning to a supply flow channel side from the pressure chamber upon discharge of the droplet by driving of the actuator, plus a displacement volume of the film member, is equal to or less than ½ of a removed volume of the pressure chamber caused by the actuator.

7. The discharge determination device as defined in claim 1, wherein a sum of a volume of liquid flowing to a nozzle side from the pressure chamber upon discharge of the droplet by driving of the actuator, plus a displacement volume of the film member, is equal to or less than ½ of a removed volume of the pressure chamber caused by the actuator.

8. The discharge determination device as defined in claim 1, wherein the pressure determination device comprises a displacement restriction device which restricts an amount of displacement of the film member.

9. The discharge determination device as defined in claim 8, wherein the displacement restriction device is arranged in a face of the film member reverse to a face forming the portion of the face of the pressure chamber, and has a shape of projection so as to restrict the displacement of the film member when a tip of the displacement restriction device abuts against a face of a cavity.

10. The discharge determination device as defined in claim 1, wherein the actuator is formed on one surface of the portion of the pressure chamber to which the actuator is joined, another surface of the portion of the pressure chamber to which the actuator is joined forms another face of the pressure chamber, and is opposite the face formed by the film member, and the actuator does not cause the film member to deform, but causes the portion of the pressure chamber to which the actuator is joined to deform.

11. The discharge determination device as defined in claim 1, wherein a cavity is disposed across the film member from the pressure chamber, the pressure determination device converts the displacement of the film member to an electronic signal to output the determination signal corresponding to pressure of the liquid, and when the actuator causes the pressure change in the liquid inside the pressure chamber needed for discharging the droplet of liquid, the film member is displaced so that displacement volume of the film member is not greater than ½ of excluded volume of the pressure chamber caused by the actuator.

12. The discharge determination device as defined in claim 1, wherein a cavity is disposed across the film member from the pressure chamber the pressure determination device converts the displacement of the film member to an electronic signal to output the determination signal corresponding to pressure of the liquid, and when the actuator causes the pressure change in the liquid inside the pressure chamber needed for discharging the droplet of liquid, the film member is displaced so that displacement volume of the film member is not greater than ⅛ of excluded volume of the pressure chamber caused by the actuator.

13. The discharge determination device as defined in claim 1, wherein one surface of the film member which is reverse to the pressure chamber faces a void portion.

14. A discharge determination method for determining discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the method comprising the steps of:

providing a film member inside at least one of the pressure chamber and the supply flow channel, so as to form a portion of a face constituting the one of the pressure chamber and the supply flow channel, the film member being displaceable in accordance with pressure change in the liquid inside the one of the pressure chamber and the supply flow channel;

acquiring a determination signal corresponding to displacement of the film member; and judging the discharge status of the nozzle according to the determination signal obtained in accordance with driving of the actuator, wherein the film member formed in the pressure chamber forms the portion of the face constituting the pressure chamber that differs from another face of the pressure chamber which is formed by a portion of the pressure chamber to which the actuator is joined, the portion of the face constituting the pressure chamber that is formed by the film member is less than the entire face constituting the pressure chamber, and the droplet of liquid is discharged from the nozzle in a direction in which the film member is displaced.

15. The discharge determination method as defined in claim 14, wherein a cavity is disposed across the film member from the pressure chamber and/or the supply flow channel, when the actuator causes the pressure change in the liquid inside the pressure chamber needed for discharging the droplet of the liquid, the film member is displaced so that displacement volume of the film member is not greater than ½ of excluded volume of the pressure chamber caused by the actuator, and the displacement of the film member is converted to an electronic signal to acquire the determination signal corresponding to pressure of the liquid.

16. The discharge determination method as defined in claim 14, wherein the displacement of the film member is converted to an electronic signal to acquire the determination signal corresponding to pressure of the liquid, the displacement of the film member is restricted, the film member has a property such that, if the displacement of the film member is not restricted and the pressure change needed for discharging the droplet of the liquid were to be applied to the liquid inside the pressure chamber, the film member would be displaced so that the droplet of the liquid would not be discharged, and when the displacement of the film member is restricted, the amount of displacement of the film member is restricted so that:

when pressure change is applied to the liquid inside the pressure chamber when a bubble is present in the liquid and is of an amount such that the droplet of the liquid is not discharged, the amount of displacement of the film member is not less than a limit value permitting the pressure determination device to output the determination signal; and when pressure change is applied to the liquid inside the pressure chamber and is of a amount such that the droplet of the liquid is discharged, the amount of displacement of the film member is not greater than a limit value permitting discharge of the droplet of the liquid.

17. The discharge determination method as defined in claim 14, wherein one surface of the film member which is reverse to the pressure chamber faces a void portion.

18. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein the portion of the face constituting the pressure chamber that is formed by the film member is less than the entire face constituting the pressure chamber, the film member is spaced apart from at least a portion of the pressure chamber to which the actuator is joined, the film member forms the portion of the face constituting the pressure chamber that differs from another face of the pressure chamber which is formed by the portion of the pressure chamber to which the actuator is joined, the pressure determination device comprises a displacement restriction device which restricts an amount of displacement of the film member, the pressure determination device converts the displacement of the film member to an electronic signal to output the determination signal corresponding to pressure of the liquid, the film member has a property such that, if the displacement restriction device were not provided and the pressure change needed for discharging the droplet of the liquid were to be applied to the liquid inside the pressure chamber, the film member would be displaced so that the droplet of the liquid would not be discharged, and when the displacement restriction device is provided, the displacement restriction device restricts the amount of displacement of the film member so that:

when pressure change is applied to the liquid inside the pressure chamber when a bubble is present in the liquid and is of an amount such that the droplet of the liquid is not discharged, the amount of displacement of the film member is not less than a limit value permitting the pressure determination device to output the determination signal; and when pressure change is applied to the liquid inside the pressure chamber and is of an amount such that the droplet of the liquid is discharged, the amount of displacement of the film member is not greater than a limit value permitting discharge of the droplet of the liquid.

19. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; a diaphragm forming a first face constituting the pressure chamber; and an actuator bonded to the diaphragm and which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member having a first surface forming a portion of a second face constituting the pressure chamber that is opposed to the first face, and a second surface, opposed to the first surface, facing a cavity having limited volume, the film member being displaceable into the cavity in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein the portion of the second face constituting the pressure chamber that is formed by the film member is less than the entire second face constituting the pressure chamber, the film member is spaced apart from at least a portion of the pressure chamber to which the actuator is joined, and the droplet of liquid is discharged from the nozzle in a direction in which the film member is displaced.

20. A discharge determination method for determining discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; a diaphragm forming a first face constituting the pressure chamber; and an actuator bonded to the diaphragm and which causes the droplet to be discharged from the nozzle by causing at least a portion of the pressure chamber to deform and thereby applies a pressure change to the liquid inside the pressure chamber, the method comprising the steps of:

providing a film member inside the pressure chamber, the film member having a first surface forming a portion of a second face constituting the pressure chamber that is opposed to the first face, and a second surface, opposed to the first surface, facing a cavity having limited volume, the film member being displaceable into the cavity in accordance with pressure change in the liquid inside the pressure chamber;

acquiring a determination signal corresponding to displacement of the film member; and judging the discharge status of the nozzle according to the determination signal obtained in accordance with driving of the actuator, wherein the portion of the second face constituting the pressure chamber that is formed by the film member is less than the entire second face constituting the pressure chamber, and the droplet of liquid is discharged from the nozzle in a direction in which the film member is displaced.

21. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein the portion of the face constituting the pressure chamber that is formed by the film member is less than the entire face constituting the pressure chamber, the film member is spaced apart from at least a portion of the pressure chamber to which the actuator is joined, the film member forms the portion of the face constituting the pressure chamber that differs from another face of the pressure chamber which is formed by the portion of the pressure chamber to which the actuator is joined, the pressure determination device comprises a displacement restriction device which restricts an amount of displacement of the film member, and the displacement restriction device has a shape of projection and is arranged in a face opposing the film member so that the displacement restriction device is spaced apart from the film member.

22. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein the portion of the face constituting the pressure chamber that is formed by the film member is less than the entire face constituting the pressure chamber, the film member is spaced apart from at least a portion of the pressure chamber to which the actuator is joined, the film member forms the portion of the face constituting the pressure chamber that differs from another face of the pressure chamber which is formed by the portion of the pressure chamber to which the actuator is joined, and the pressure determination device comprises a displacement restriction device which restricts an amount of displacement of the film member the displacement restriction device has:

a first stopper member which has a shape of projection and is arranged in a face opposing the film member so that the first stopper member is spaced apart from the film member at an interval required for determining the discharge status; and a second stopper member which has an arch-like shape, is placed over an effective movement region of the film member, and includes a projection forming a contact portion with respect to the film member and being located across the film member from the first stopper member in such a manner that the second stopper member opposes the first stopper member.

23. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein:

the portion of the face constituting the pressure chamber that is formed by the film member is less than the entire face constituting the pressure chamber;

the film member is spaced apart from at least a portion of the pressure chamber to which the actuator is joined;

the film member forms the portion of the face constituting the pressure chamber that differs from another face of the pressure chamber which is formed by the portion of the pressure chamber to which the actuator is joined;

the pressure determination device comprises a displacement restriction device which restricts an amount of displacement of the film member;

the film member has a thin central region forming a recess section, and a thin portion in a periphery of an effective movement region of the film member; and the displacement restriction device is arranged so as to form a narrow groove between the displacement restriction device and the film member in such a manner that when pressure is applied to the film member, the narrow groove is displaced and the displacement restriction device abuts against the film member so as to restrict the amount of displacement of the film member.

24. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member; and a discharge status judging device which judges the discharge status of the nozzle according to the determination signal obtained from the pressure determination device in accordance with driving of the actuator, wherein the portion of the face constituting the pressure chamber that is formed by the film member is less than the entire face constituting the pressure chamber, the film member is spaced apart from at least a portion of the pressure chamber to which the actuator is joined, the film member forms the portion of the face constituting the pressure chamber that differs from another face of the pressure chamber which is formed by the portion of the pressure chamber to which the actuator is joined, and the pressure determination device includes the film member, a cavity and a determination electrode which is arranged across the cavity from the film member.

25. A discharge determination device which determines discharge status in a droplet discharge apparatus comprising: a nozzle which discharges a droplet of liquid; a pressure chamber which is connected to the nozzle and stores the liquid to be discharged from the nozzle; a supply flow channel which supplies the liquid to the pressure chamber and is connected to the pressure chamber; and an actuator which causes the droplet to be discharged from the nozzle by causing at least a portion of the pressure chamber to deform and thereby applies a pressure change to the liquid inside the pressure chamber, the discharge determination device comprising:

a pressure determination device which is disposed inside the pressure chamber and includes a film member forming a portion of a face constituting the pressure chamber, the film member being displaceable in accordance with pressure change in the liquid inside the pressure chamber, the pressure determination device outputting a determination signal in accordance with displacement of the film member;

a discharge status judging device which compares the determination signal obtained from the pressure determination device in accordance with driving of the actuator, with the determination signal obtained when the droplet of liquid is normally ejected, so as to judge whether the droplet of liquid is discharged from the nozzle or not; and a displacement restriction device which restricts an amount of displacement of the film member, wherein the film member is constituted by a film having a displacement property such that, supposing that a pressure change required for discharging the droplet of liquid is applied to the liquid in the pressure chamber in a state where the discharge determination device does not have the displacement restriction device, then the film member is displaced to cause the droplet of liquid not to be discharged, and the displacement restriction device restricts the amount of displacement of the film member in such a manner that, when a pressure change required for discharging the droplet of liquid is applied to the liquid in the pressure chamber, then the film member is displaced by not less than a limit value such that the determination signal can be output and not greater than a limit value such that no discharge of the droplet of liquid is not caused, regardless of bubbles of the liquid in the pressure chamber.

* * * * *